US010199766B2

(12) United States Patent
Smajda

(10) Patent No.: US 10,199,766 B2
(45) Date of Patent: Feb. 5, 2019

(54) BREAKAWAY RAILCAR POWER CONNECTOR

(71) Applicant: Westinghouse Air Brake Technologies Corporation, Wilmerding, PA (US)

(72) Inventor: Kenneth J. Smajda, Elkridge, MD (US)

(73) Assignee: Westinghouse Air Brake Technologies Corporation, Wilmerding, PA (US)

( * ) Notice: Subject to any disclaimer, the term of this patent is extended or adjusted under 35 U.S.C. 154(b) by 107 days.

(21) Appl. No.: 15/135,951

(22) Filed: Apr. 22, 2016

(65) Prior Publication Data

US 2017/0310044 A1 Oct. 26, 2017

(51) Int. Cl.

| | |
|---|---|
| ***H01R 13/629*** | (2006.01) |
| ***H01R 13/623*** | (2006.01) |
| ***B61G 5/10*** | (2006.01) |
| ***H01R 13/635*** | (2006.01) |

(52) U.S. Cl.

CPC ..... *H01R 13/623* (2013.01); *B61G 5/10* (2013.01); *H01R 13/635* (2013.01)

(58) Field of Classification Search

CPC ..... H01R 13/193; H01R 13/6277; H01R 13/6395; H01R 13/6275; H01R 13/6272; H01R 13/743; H01R 13/745; H01R 13/6278; H01R 11/22; H01R 11/32; H01R 2103/00

USPC ..... 439/263, 314, 352, 358, 368–372, 552, 439/575, 578

See application file for complete search history.

(56) References Cited

U.S. PATENT DOCUMENTS

| | | | | |
|---|---|---|---|---|
| 2,933,711 A * | 4/1960 | Eaton | H01R 13/633 | 403/349 |
| 3,271,726 A * | 9/1966 | Pfendler | H01R 23/27 | 29/830 |
| 3,680,033 A * | 7/1972 | Kawai | H01R 13/627 | 285/316 |
| 3,971,614 A * | 7/1976 | Paoli | H01R 13/621 | 285/85 |
| D243,407 S | 2/1977 | Mooney et al. | | |
| 4,457,572 A * | 7/1984 | Frazier | H01R 13/622 | 439/312 |
| 4,472,013 A * | 9/1984 | Frear | H01R 13/622 | 439/312 |
| 4,497,530 A * | 2/1985 | Shannon | H01R 13/622 | 439/312 |
| 4,595,251 A * | 6/1986 | Moulin | G02B 6/3816 | 439/289 |

(Continued)

FOREIGN PATENT DOCUMENTS

| | | | |
|---|---|---|---|
| EP | 1050931 A1 * | 11/2000 | H01R 13/625 |
| KR | 1020140062930 A | 5/2014 | |

*Primary Examiner* — Amy Cohen Johnson
*Assistant Examiner* — Milagros Jeancharles
(74) *Attorney, Agent, or Firm* — The Webb Law Firm

(57) ABSTRACT

A railcar power connector includes a connector body defining a central opening configured to receive a portion of a cable, and a spring member having a protrusion moveable relative to the connector body between a locked position where the protrusion is configured to be secured to a mating connector and a released position where the protrusion is configured to be released from a corresponding recess of a mating connector. The protrusion moveable from the locked position to the released position upon a predetermined axial force applied to the spring member.

10 Claims, 26 Drawing Sheets

(56) References Cited

U.S. PATENT DOCUMENTS 4,629,272 A * 12/1986 Mattingly ..... H01R 13/625 439/318
4,639,064 A * 1/1987 Knapp ..... H01R 13/622 439/318
5,082,454 A * 1/1992 Tonkiss ..... H01R 13/622 439/312
5,131,862 A * 7/1992 Gershfeld ..... H01R 13/625 439/357
5,192,219 A * 3/1993 Fowler ..... H01R 13/622 285/92
D336,070 S 6/1993 Clark
5,658,159 A * 8/1997 Gardner ..... B61G 5/10 213/76
D406,816 S 3/1999 Hopper et al.
6,173,849 B1 * 1/2001 Stevens ..... B60T 17/043 213/1.3
6,602,093 B1 * 8/2003 Cannon ..... H01R 13/625 439/578
6,669,506 B2 * 12/2003 Newton ..... B60T 13/665 439/559
6,808,407 B1 * 10/2004 Cannon ..... H01R 13/625 439/314
6,848,931 B2 * 2/2005 McMullen ..... H01R 24/40 439/350
6,908,118 B2 * 6/2005 Fumioka ..... A61M 39/1011 285/277
7,097,490 B2 * 8/2006 Eaton ..... H01R 13/633 439/350
D580,876 S 11/2008 Farahani
7,587,244 B2 * 9/2009 Olbertz ..... A61N 1/3752 607/37
7,748,986 B1 * 7/2010 Parnapy ..... B60T 13/665 439/34
D633,872 S 3/2011 Shen et al.
9,093,783 B2 * 7/2015 Grimm ..... H01R 13/625
9,099,807 B2 * 8/2015 Opgenorth ..... H01R 13/622
9,136,658 B2 * 9/2015 Chang ..... H01R 27/00
D749,047 S 2/2016 Smith
D754,073 S 4/2016 Katagiyama et al.
9,412,530 B2 * 8/2016 Kirita ..... F02N 11/0807
9,437,961 B1 * 9/2016 Smajda ..... H01R 13/5219
9,437,965 B2 * 9/2016 Zitsch ..... H01R 13/62
D769,822 S 10/2016 Reynolds
D781,787 S 3/2017 Spiel
D782,982 S 4/2017 Katagiyama et al.
D794,573 S 8/2017 Tateishi
2004/0014350 A1 * 1/2004 McMullen ..... H01R 24/40 439/350
2006/0063396 A1 * 3/2006 Bankstahl ..... B23K 9/32 439/11
2009/0269958 A1 * 10/2009 Fujiwara ..... H01R 13/5219 439/320
2010/0173504 A1 * 7/2010 Parnapy ..... B60T 13/665 439/34
2010/0297875 A1 11/2010 Purdy et al.
2011/0294329 A1 * 12/2011 Sasaki ..... H01R 13/625 439/320
2012/0252256 A1 10/2012 Zhu et al.
2013/0221166 A1 8/2013 Henniges et al.
2014/0050443 A1 2/2014 Lee
2014/0302724 A1 * 10/2014 Ono ..... H01R 13/4364 439/751
2015/0050827 A1 * 2/2015 Chang ..... H01R 27/00 439/312
2015/0110447 A1 4/2015 Elenbaas et al.

* cited by examiner

BREAKAWAY RAILCAR POWER CONNECTOR

BACKGROUND OF THE INVENTION

Field of the Invention

The present invention relates generally to connection arrangements and other physical and/or electrical connections by and between railroad cars, i.e., railcars, and, in particular, to a railcar power connector assembly for connections between a cable and an end-of-car fitting.

Description of the Related Art

As is known in the railroad industry, a train is made up of multiple railcars that are interconnected. Each railcar is connected with at least one other railcar using mechanical connection arrangements. Further, the majority of railroad trains are equipped with air brakes, where an air hose is connected between adjacent cars in order to facilitate the flow of compressed air to operate the brakes on each car. Similarly, trains equipped with electronically controlled pneumatic (ECP) braking systems are provided with electrical cables that extend along and through each railcar in order to provide electrical communication between cars. Each railcar is provided with a cable connection that is mounted at or near the ends of the car.

In order to make the electrical connection between adjacent cars, an inter-car cable is provided. The inter-car cable typically includes a first end and a second end. The first end includes a connection arrangement to connect to the cable to an end-of-car (EOC) fitting on the railcar, and a second end includes a connection arrangement to connect to the second end of another inter-car cable. The connection between the EOC fitting and the cable typically includes a breakaway feature to provide disconnection from the EOC upon a predetermined force acting on the connection. The breakaway feature prevents damage to the cable connection and/or the EOC fitting should there be a pull-apart of the train car and failure of the inter-car connection to release.

A conventional arrangement for the connection between the EOC fitting and the cable includes an elastomer housing that receives communication and electrical contacts and is secured to the EOC fitting with a nut. The elastomer housing surrounding the contacts has a small flange on the rear of the housing that is engaged by the nut to secure the cable to the EOC fitting. Upon a predetermined force, typically not exceeding 800 pounds, the cable will pull out of the EOC fitting by deforming the flange of the elastomer housing and passing through the rear of the nut. When the cable pulls free from the EOC fitting, an operator must remove the nut from the EOC fitting, feed the cable back through the nut, and replace a small split nylon friction washer back onto the cable. The friction washer is typically lost during the break apart and must be available so that it can be replaced for the connection to work properly. The elastomer housing must be aligned with the EOC fitting to ensure proper orientation of the contacts and the nut is then installed on the EOC fitting. The nut must be retightened and torqued to predetermined specifications, which can be time consuming and requires specific tools to achieve the required specifications. Further, because this conventional connection utilizes the elastomer housing, over torquing the nut, loss of lubrication, or foreign material on the housing can cause the elastomer housing to spin with the nut during installation thereby damaging the electrical contacts within the housing beyond repair.

SUMMARY OF THE INVENTION

Accordingly and generally, provided are an improved breakaway railcar power connector assembly and method of retrofitting a railcar power cable.

In one preferred and non-limiting embodiment or aspect of the present invention, provided is a railcar power connector having a cable connector body defining a central opening configured to receive a portion of a cable, and a spring member having a protrusion. The protrusion is moveable relative to the cable connector body between a locked position, where the protrusion is configured to be secured to a mating connector, and a released position, where the protrusion is configured to be released from a corresponding recess of a mating connector. The protrusion is moveable from the locked position to the released position upon a predetermined axial force applied to the spring member.

In one preferred and non-limiting embodiment or aspect, the protrusion of the spring member extends radially inward, with the protrusion of the spring member moving in a radial direction between the locked position and the released position, and where the spring member is rotatable relative to the cable connector body. The protrusion may be embodied as a pin.

In one preferred and non-limiting embodiment or aspect, the spring member includes a body that forms a cantilever spring, with a first end of the body of the spring member fixed relative to the cable connector body with a second end of the body of the spring member moveable relative to the cable connector body. The assembly may further include a coupler ring configured to receive the cable connector body, with the coupler ring secured to the body of the spring member, the coupler ring defining an opening that receives the protrusion. The assembly may also include a cover configured to be secured to the cable connector body, with the cover securing the coupler ring between the cable connector body and the cover.

In one preferred and non-limiting embodiment or aspect, the cable connector body includes an outer key extending radially outward from the cable connector body, with the outer key of the cable connector body configured to be received by a corresponding key recess of a mating connector.

In one preferred and non-limiting embodiment or aspect, the assembly includes a clamp member configured to be positioned about a cable, where the cable connector body compresses the clamp member when the clamp member is received within the cable connector body. The cable connector body may also include an inner key extending radially inward from the cable connector body, with the inner key of the cable connector body received by a key recess defined by the clamp member.

In one preferred and non-limiting embodiment or aspect, provided is a railcar power connector assembly having an end-of-car connector assembly including an end-of-car connector body and a threaded member, with the threaded member configured to secure the end-of-car connector assembly to an end-of-car fitting positioned on a railcar. The assembly also includes a cable connector assembly including a cable connector body and a clamp member, with the clamp member configured to be positioned about a cable. The cable connector body defines a central opening and is configured to compress the clamp member when the clamp member is received within the cable connector body. The cable connector assembly includes one of a spring member and a securing recess and the end-of-car connector assembly includes the other one of the spring member and the securing recess. The spring member includes a protrusion moveable in a radial direction between a locked position, where the protrusion is configured to be received within the securing recess, and a released position, where the protrusion is configured to be released from the securing recess. The protrusion is moveable from the locked position to the released position upon a predetermined axial force applied to the spring member. The cable connector assembly is configured to be secured and removed from the end-of-car connector assembly, with the protrusion received within the securing recess when the cable connector assembly is secured to the end-of-car connector assembly.

In one preferred and non-limiting embodiment or aspect, the cable connector assembly includes the spring member and the end-of-car connector body defines the securing recess. The protrusion may be embodied as a pin, and the securing recess may be L-shaped and include a tapered surface. The securing recess may include a locking detent.

In one preferred and non-limiting embodiment or aspect, the end-of-car connector body includes an index washer having a projection configured to engage an end-of-car fitting and to align the cable connector assembly relative to the end-of-car connector assembly.

In one preferred and non-limiting embodiment or aspect, the threaded member includes a flange, with the flange engaging the end-of-car connector body when the threaded member secures the end-of-car connector body to the end-of-car fitting.

In one preferred and non-limiting embodiment or aspect, the spring member may include a body that forms a cantilever spring, with the spring member being rotatable relative to the cable connector body.

In one preferred and non-limiting embodiment or aspect, the cable connector body includes an outer key extending radially outward from the cable connector body, with the outer key of the cable connector body configured to be received by a corresponding key recess of the end-of-car connector body. The cable connector body may also include an inner key extending radially inward from the cable connector body, with the inner key of the cable connector body received by key recess defined by the clamp member.

In one preferred and non-limiting embodiment or aspect, provided is a method of retrofitting a railcar power cable, including positioning a cable connector assembly over an end of a cable, with the cable connector assembly having a cable connector body, a spring member having a protrusion, and a clamp member. The protrusion is moveable relative to the cable connector body between a locked position, where the protrusion is configured to be secured to a mating connector, and a released position, where the protrusion is configured to be released from a corresponding recess of a mating connector. The protrusion is moveable from the locked position to the released position upon a predetermined axial force applied to the spring member. The method further includes positioning the connector body over the clamp member and securing the cable connector body to the cable and securing an end-of-car connector body to an end-of-car fitting. The end-of-car connector body defines a securing recess configured to receive the protrusion when the cable connector assembly is secured to the end-of-car connector body.

In one preferred and non-limiting embodiment or aspect, the end-of-car connector body is secured to the end-of-car fitting via a threaded member received by a corresponding threaded portion of the end-of-car fitting.

Further preferred and non-limiting embodiments or aspects will now be described in the following numbered clauses.

Clause 1: A railcar power connector, comprising: a cable connector body defining a central opening configured to receive a portion of a cable; a spring member having a protrusion, the protrusion moveable relative to the cable connector body between a locked position where the protrusion is configured to be secured to a mating connector and a released position where the protrusion is configured to be released from a corresponding recess of a mating connector, the protrusion moveable from the locked position to the released position upon a predetermined axial force applied to the spring member.

Clause 2: The railcar power connector of clause 1, wherein the protrusion of the spring member extends radially inward, the protrusion of the spring member moving in a radial direction between the locked position and the released position, and wherein the spring member is rotatable relative to the cable connector body.

Clause 3: The railcar power connector of clauses 1 or 2, wherein the protrusion comprises a pin.

Clause 4: The railcar power connector of clauses 1-3, wherein the spring member comprises a body that forms a cantilever spring, a first end of the body of the spring member is fixed relative to the cable connector body with a second end of the body of the spring member moveable relative to the cable connector body.

Clause 5: The railcar power connector of any of clauses 1-4, further comprising a coupler ring configured to receive the cable connector body, the coupler ring secured to the body of the spring member, the coupler ring defining an opening that receives the protrusion.

Clause 6: The railcar power connector of any of clauses 1-5, further comprising a cover configured to be secured to the cable connector body, the cover securing the coupler ring between the cable connector body and the cover.

Clause 7: The railcar power connector of any of clauses 1-6, wherein the cable connector body comprises an outer key extending radially outward from the cable connector body, the outer key of the cable connector body configured to be received by a corresponding key recess of a mating connector.

Clause 8: The railcar power connector of any of clauses 1-7, further comprising a clamp member configured to be positioned about a cable, wherein the cable connector body compresses the clamp member when the clamp member is received within the cable connector body.

Clause 9: The railcar power connector of any of clauses 1-8, wherein the cable connector body comprises an inner key extending radially inward from the cable connector body, the inner key of the cable connector body received by a key recess defined by a clamp member.

Clause 10: A railcar power connector assembly, comprising: an end-of-car connector assembly comprising an end-of-car connector body and a threaded member, the threaded member configured to secure the end-of-car connector assembly to an end-of-car fitting positioned on a railcar; a cable connector assembly comprising a cable connector body and a clamp member, the clamp member configured to be positioned about a cable, the cable connector body defining a central opening and configured to compress the clamp member when the clamp member is received within the cable connector body, wherein the cable connector assembly includes one of a spring member and a securing recess and the end-of-car connector assembly includes the other one of the spring member and the securing recess, the spring member includes a protrusion moveable in a radial direction between a locked position where the protrusion is configured to be received within the securing recess and a released position where the protrusion is configured to be released from the securing recess, the protrusion moveable from the locked position to the released position upon a predetermined axial force applied to the spring member, and wherein the cable connector assembly is configured to be secured and removed from the end-of-car connector assembly, the protrusion received within the securing recess when the cable connector assembly is secured to the end-of-car connector assembly.

Clause 11: The railcar power connector assembly of clause 10, wherein the cable connector assembly includes the spring member and the end-of-car connector body defines the securing recess.

Clause 12: The railcar power connector assembly of clauses 10 or 11, wherein the protrusion comprises a pin, and wherein the securing recess is L-shaped and includes a tapered surface.

Clause 13: The railcar power connector assembly of any of clauses 10-12, wherein the securing recess comprises a locking detent.

Clause 14: The railcar power connector assembly of any of clauses 10-13, wherein the end-of-car connector assembly includes an index washer having a projection configured to engage an end-of-car fitting and to align the cable connector assembly relative to the end-of-car connector assembly.

Clause 15: The railcar power connector assembly of any of clauses 10-14, wherein the threaded member includes a flange, the flange engaging the end-of-car connector body when the threaded member secures the end-of-car connector body to the end-of-car fitting.

Clause 16: The railcar power connector assembly of any of clauses 10-15, wherein the spring member comprises a body that forms a cantilever spring, and wherein the spring member is rotatable relative to the cable connector body.

Clause 17: The railcar power connector of any of clauses 10-16, wherein the cable connector body comprises an outer key extending radially outward from the cable connector body, the outer key of the cable connector body configured to be received by a corresponding key recess of the end-of-car connector body.

Clause 18: The railcar power connector of any of clauses 10-17, wherein the cable connector body comprises an inner key extending radially inward from the cable connector body, the inner key of the cable connector body received by a key recess defined by the clamp member.

Clause 19: A method of retrofitting a railcar power cable, comprising: positioning a cable connector assembly over an end of a cable, the cable connector assembly comprising a cable connector body, a spring member having a protrusion, and a clamp member, the protrusion moveable relative to the cable connector body between a locked position where the protrusion is configured to be secured to a mating connector and a released position where the protrusion is configured to be released from a corresponding recess of a mating connector, the protrusion moveable from the locked position to the released position upon a predetermined axial force applied to the spring member; positioning the connector body over the clamp member and securing the cable connector body to the cable; securing an end-of-car connector body to an end-of-car fitting, the end-of-car connector body defining a securing recess configured to receive the protrusion when the cable connector assembly is secured to the end-of-car connector body.

Clause 20: The method of clause 19, wherein the end-of-car connector body is secured to the end-of-car fitting via a threaded member received by a corresponding threaded portion of the end-of-car fitting.

These and other features and characteristics of the present invention, as well as the methods of operation and functions of the related elements of structures and the combination of parts and economies of manufacture, will become more apparent upon consideration of the following description and the appended claims with reference to the accompanying drawings, all of which form a part of this specification, wherein like reference numerals designate corresponding parts in the various figures. It is to be expressly understood, however, that the drawings are for the purpose of illustration and description only and are not intended as a definition of the limits of the invention. As used in the specification and the claims, the singular form of "a", "an", and "the" include plural referents unless the context clearly dictates otherwise.

DETAILED DESCRIPTION OF THE PREFERRED EMBODIMENTS

Figure 1:
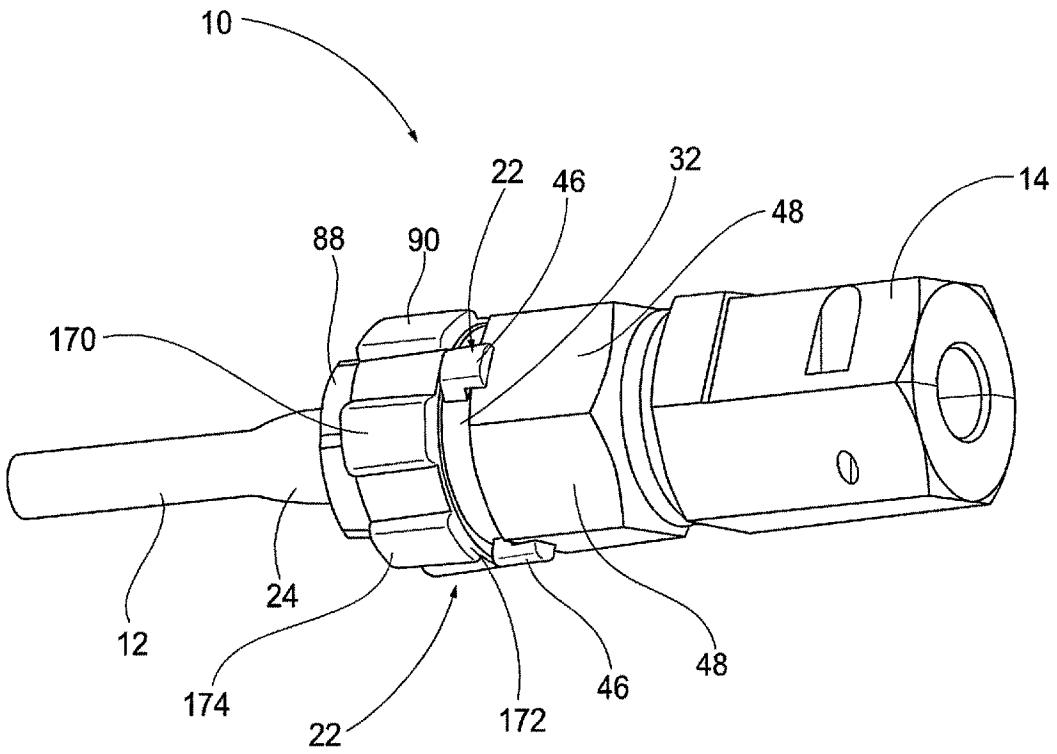
FIG. 1 is a perspective view of a railcar power connector assembly according to one aspect of the present invention.
Figure 2:
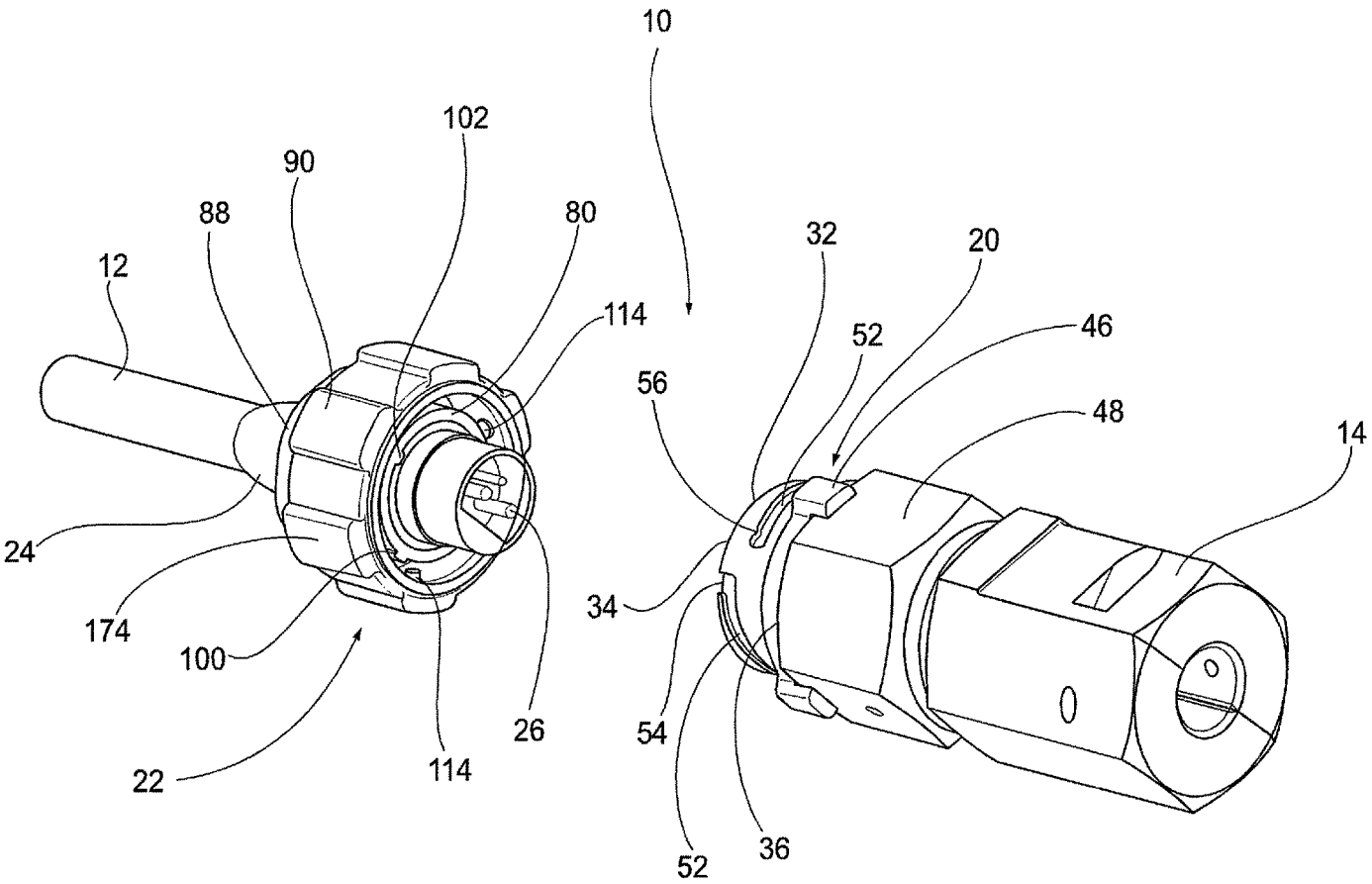
FIG. 2 is an exploded perspective view of the assembly of FIG. 1 according to one aspect of the present invention.

For purposes of the description hereinafter, the terms "end", "upper", "lower", "right", "left", "vertical", "horizontal", "top", "bottom", "lateral", "longitudinal", and derivatives thereof shall relate to the invention as it is oriented in the drawing figures. However, it is to be understood that the invention may assume various alternative variations and step sequences, except where expressly specified to the contrary. It is also to be understood that the specific devices and processes illustrated in the attached drawings, and described in the following specification, are simply exemplary embodiments of the invention. Hence, specific dimensions and other physical characteristics related to the embodiments disclosed herein are not to be considered as limiting.

Referring to FIGS. 1-10, a railcar power connector assembly 10 for attaching a cable 12 to an EOC fitting 14 is shown. The railcar power connector assembly 10 may be utilized in connection with conventional cable and EOC fitting arrangements, thereby allowing the railcar power connector assembly 10 to retrofit existing inter-car cable assemblies already in service. The railcar power connector assembly 10 provides a readily removable connection between the cable 12 and the EOC fitting 14, and also provides a breakaway feature allowing the cable 12 to release from the EOC fitting 14 to prevent damage to the cable 12. As discussed below in more detail, the railcar power connector assembly 10 allows the cable 12 to be easily reconnected to the EOC fitting 14 after a breakaway separation.

Referring again to FIGS. 1-10, and in one preferred and non-limiting embodiment or aspect, the railcar power connector assembly 10 includes an EOC connector assembly 20 for installation on the EOC fitting 14 and a cable connector assembly 22 for installation on the cable 12. Although the railcar power connector assembly 10 is shown and described as modifying an existing cable and EOC fitting, the features of the assembly 10 may also be incorporated into the design of the cable 12 and EOC fitting 14 during their respective manufacture. The cable 12 includes a flanged end 24 that receives a plurality of contacts or pins 26 configured to mate with a corresponding contact to establish electrical contact therebetween. In particular, the EOC fitting 14 includes a female pin body 28 that receives the plurality of pins 26 from the cable 12 when the cable connector assembly 22 is connected to the EOC connector assembly 20.

Figure 3:
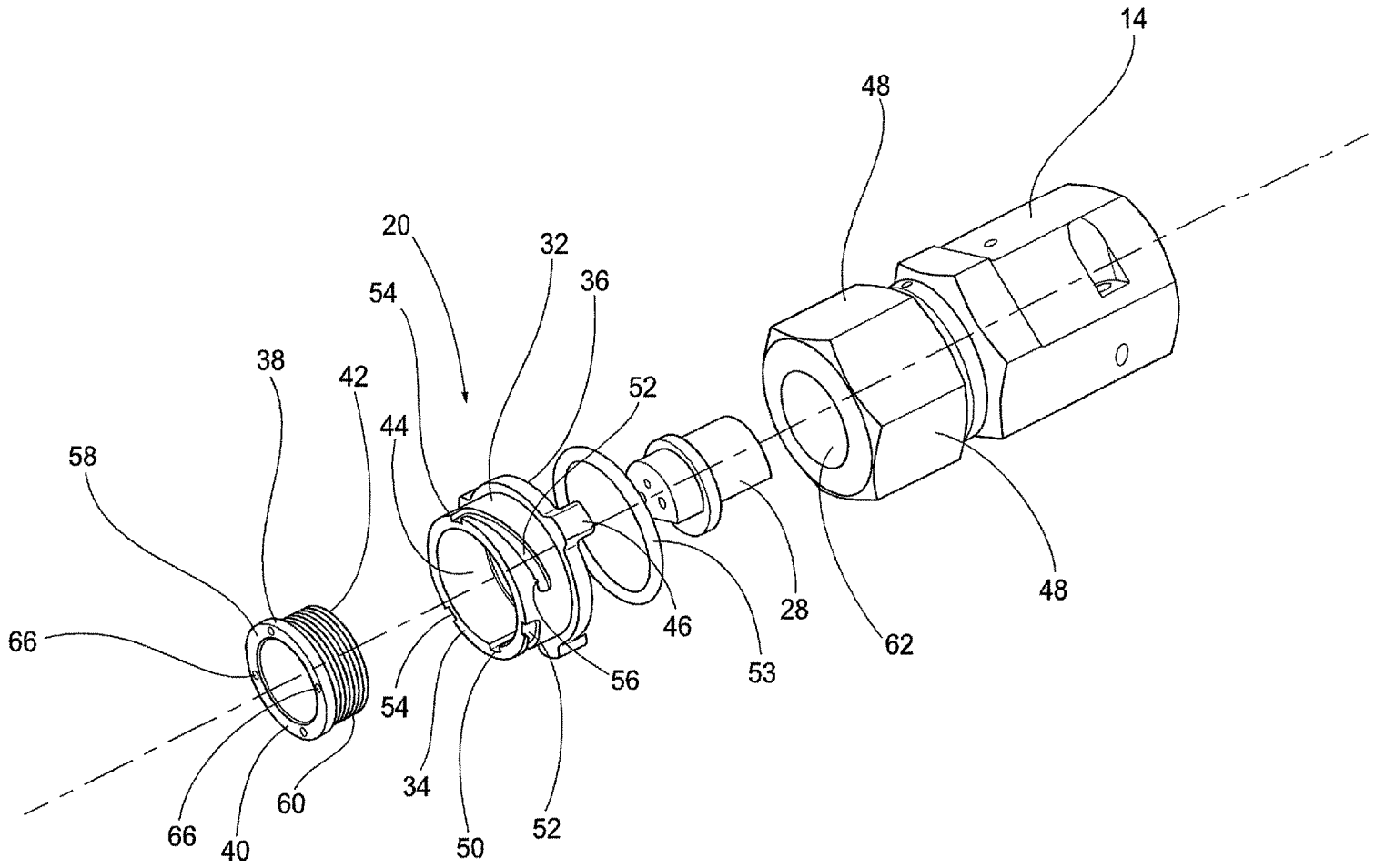
FIG. 3 is an exploded perspective view of an end-of-car connector assembly according to one aspect of the present invention.
Figure 4:
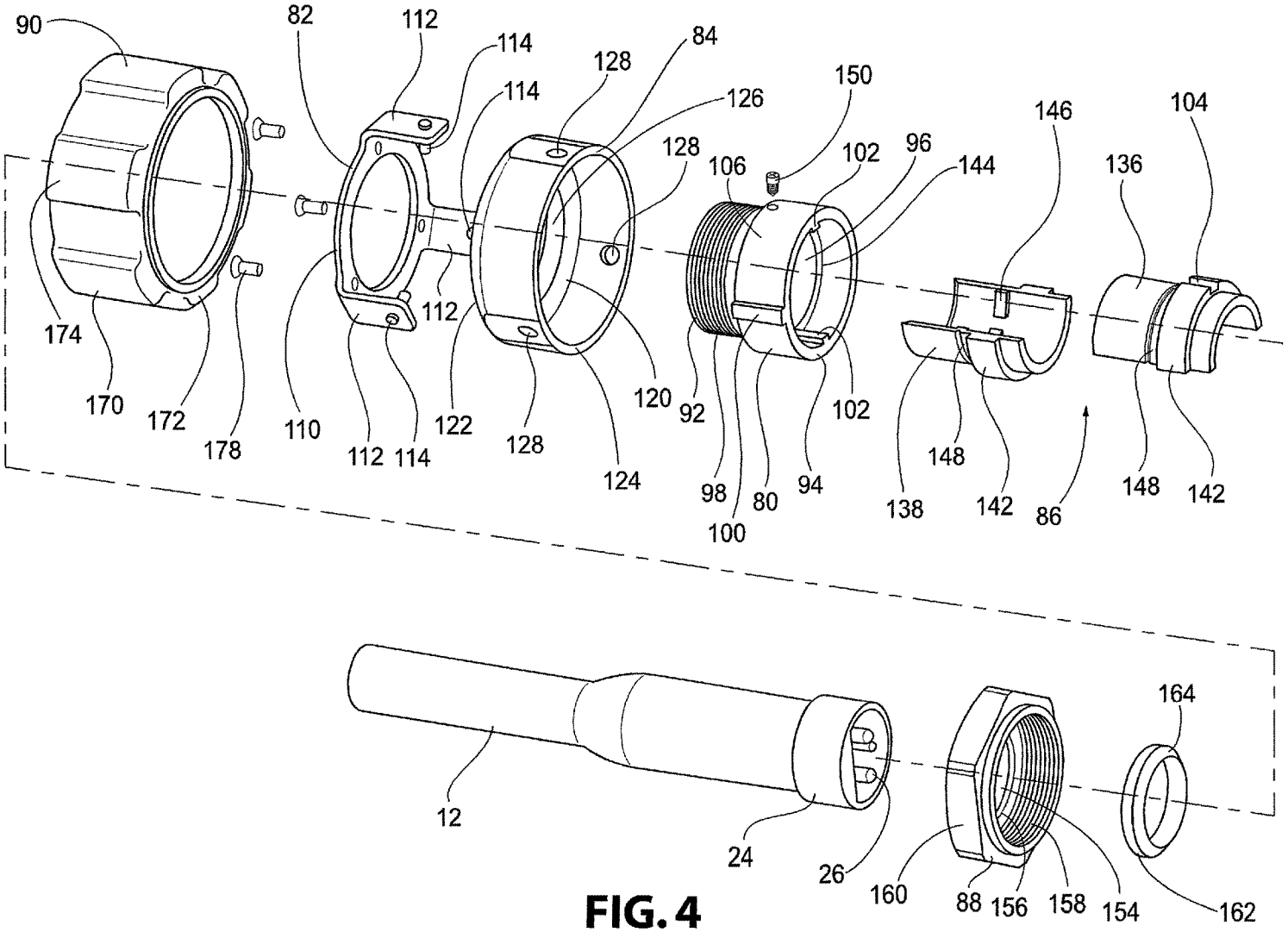
FIG. 4 is an exploded perspective view of a cable connector assembly according to one aspect of the present invention.
Figure 5:
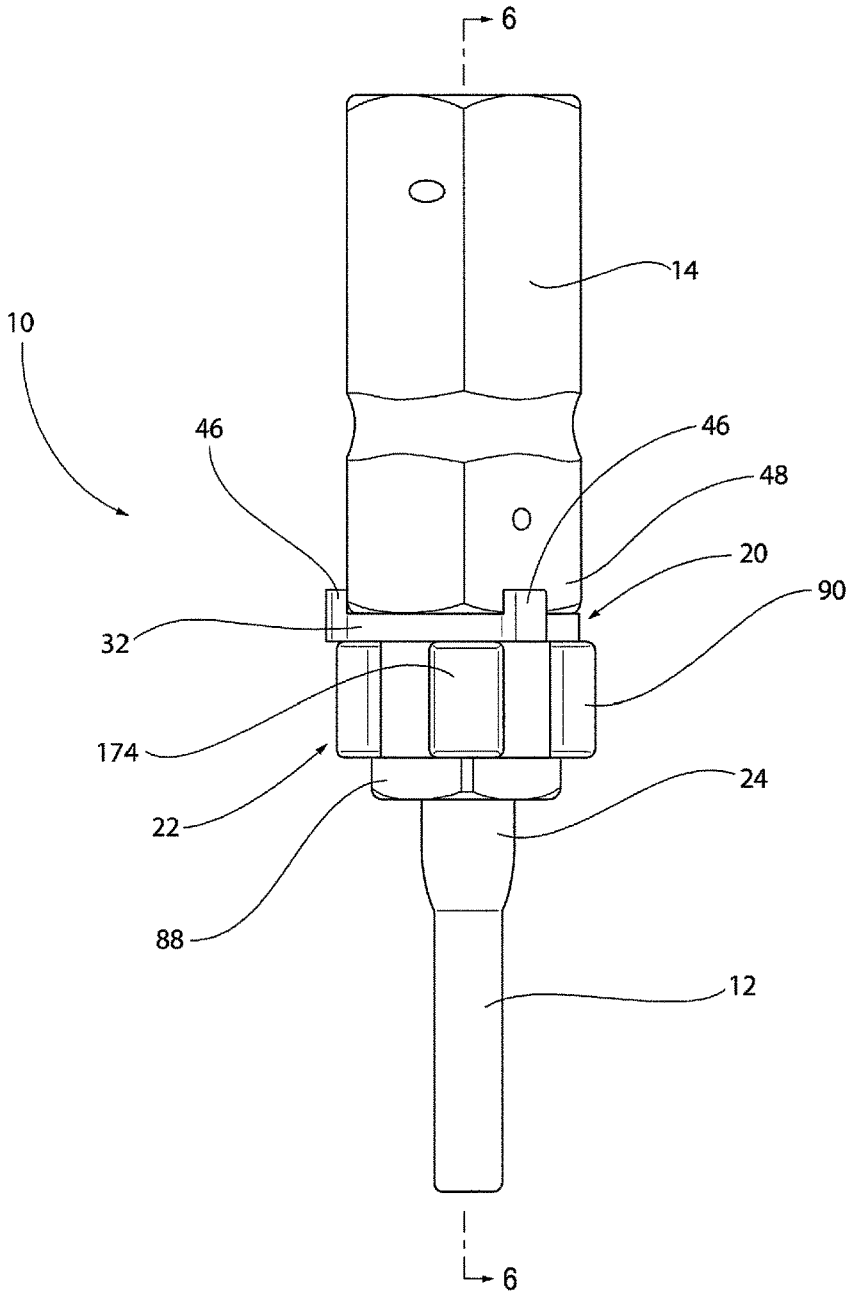
FIG. 5 is a front view of the assembly of FIG. 1 according to one aspect of the present invention.
Figure 6:
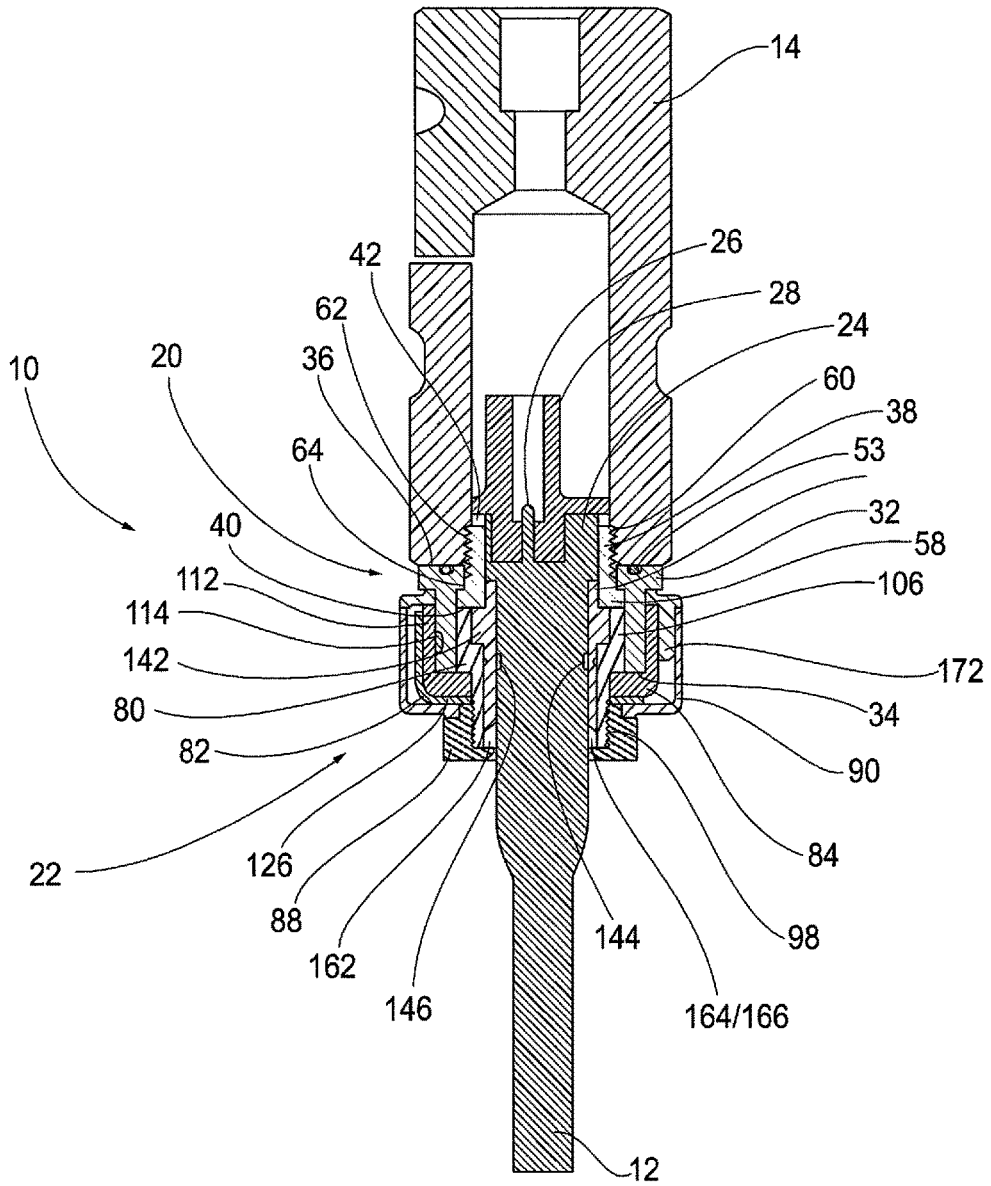
FIG. 6 is a cross-sectional view taken along line 6-6 shown in FIG. 5 according to one aspect of the present invention.
Figure 7:
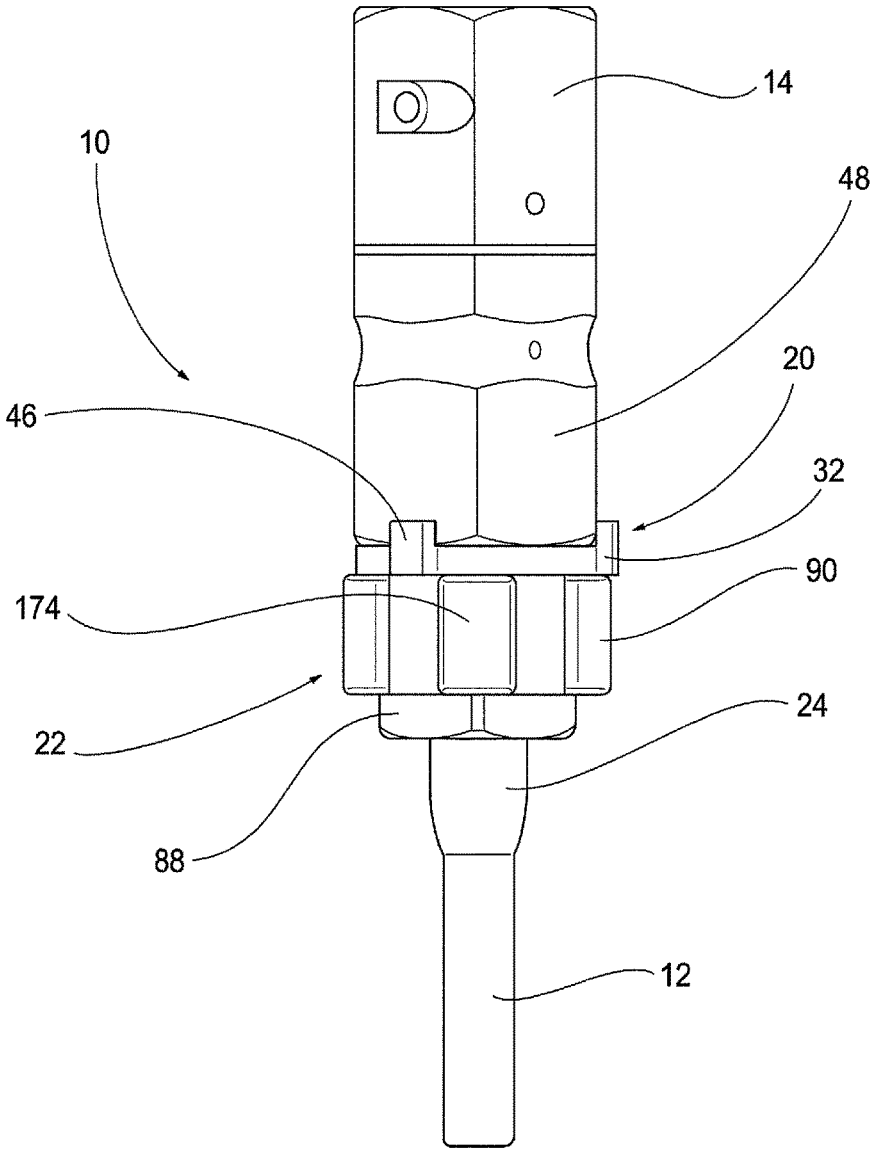
FIG. 7 is a rear view of the assembly of FIG. 1 according to one aspect of the present invention.
Figure 8:
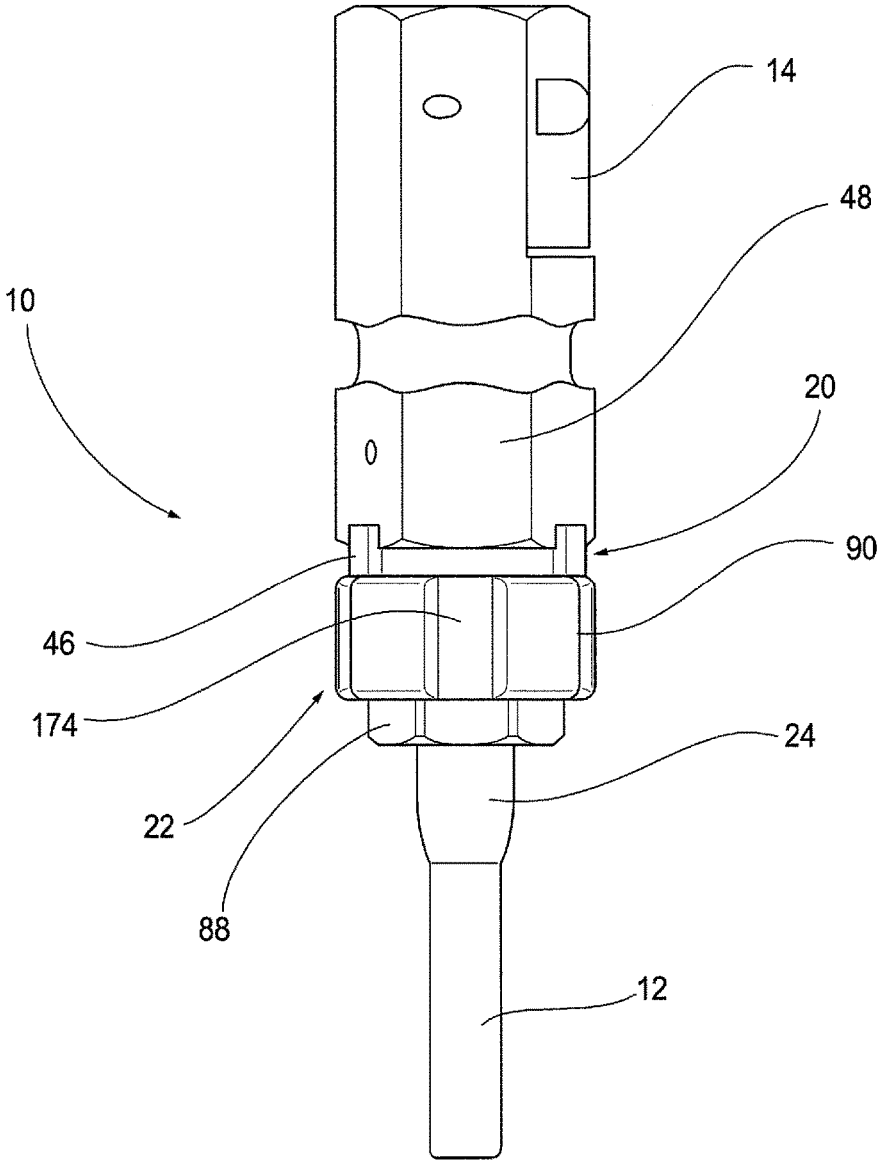
FIG. 8 is a left side view of the assembly of FIG. 1 according to one aspect of the present invention.
Figure 9:
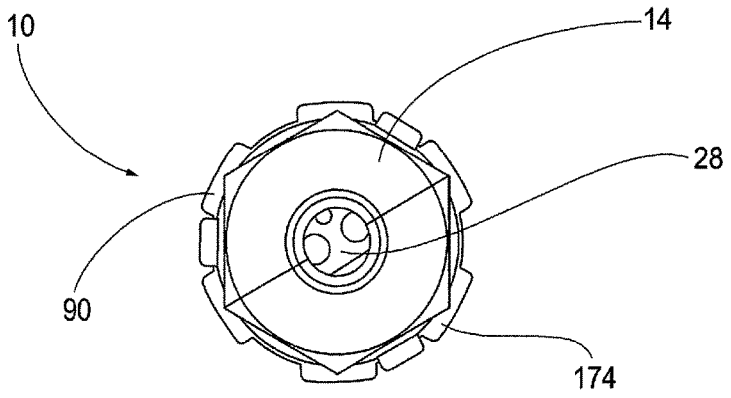
FIG. 9 is a top view of the assembly of FIG. 1 according to one aspect of the present invention.
Figure 10:
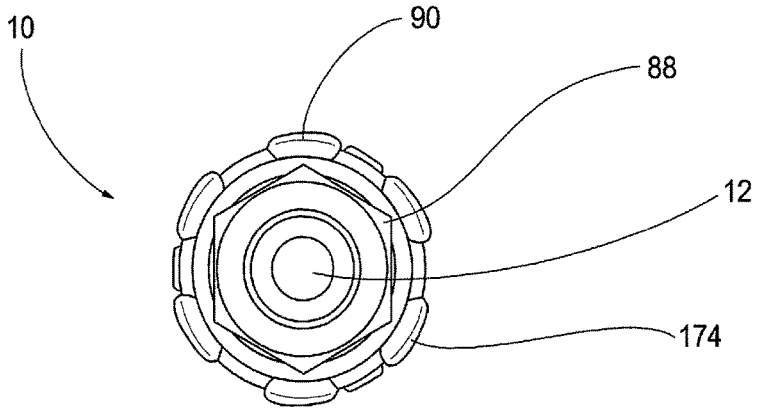
FIG. 10 is a bottom view of the assembly of FIG. 1 according to one aspect of the present invention.

Referring to FIGS. 1-14, and in one preferred and non-limiting embodiment or aspect, the EOC connector assembly 20 includes an EOC connector body 32 having a first end 34 and a second end 36 and a threaded member 38 having a first end 40 and a second end 42. The EOC connector body 32 defines a central passageway 44 extending from the first end 34 to the second end 36 of the EOC connector body 32. The EOC connector body 32 includes a plurality of projections 46 extending from the second end 36 of the EOC connector body 32 and away from the first end 34 of the EOC connector body 32. The projections 46 are configured to engage flat portions 48 of the EOC fitting 14 and prevent rotation of the EOC connector body 32 relative to the EOC fitting 14. As discussed in more detail below, the projections 46 also orient the EOC connector body 32 relative to the EOC fitting 14 to ensure proper connection between the pins 26 and the female pin body 28. Although three projections 46 are shown, one or more projections 46 may be utilized to restrict rotation and orient the EOC connector body 32 relative to the EOC fitting 14. As shown in FIG. 3, the EOC connector body 32 also defines a key recess 50 configured to receive a corresponding key from the cable connector assembly 22. The key recess 50 is a rectangular channel extending from the first end 34 of the EOC connector body 32 to a position intermediate the first and second ends 34, 36 of the EOC connector body 32. The EOC connector body 32 also defines a groove 51 adjacent the second end 36 that receives an O-ring 53. The O-ring 53 provides a sealed engagement between the EOC connector body 32 and the EOC fitting 14 when the EOC connector body 32 is mated with the EOC fitting 14.

Figure 11:
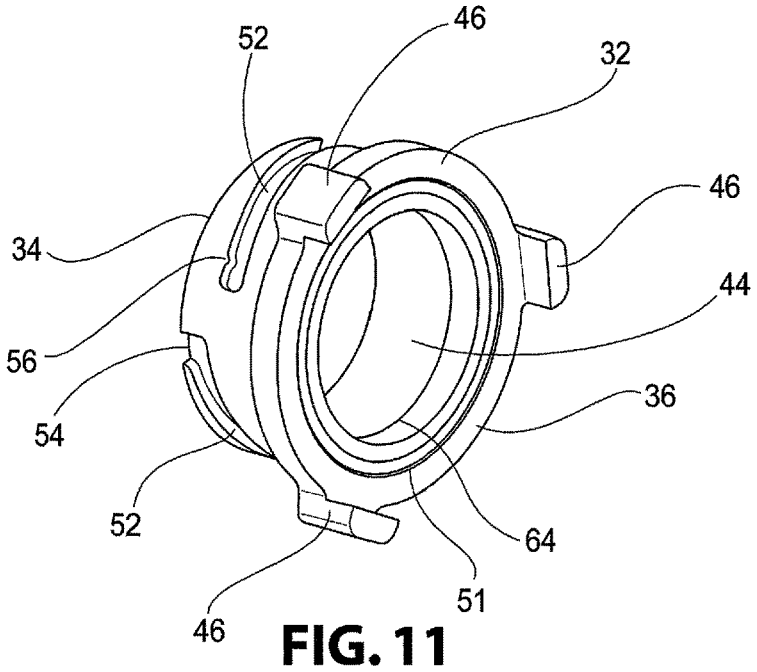
FIG. 11 is a perspective view of an end-of-car connector body according to one aspect of the present invention.
Figure 12:
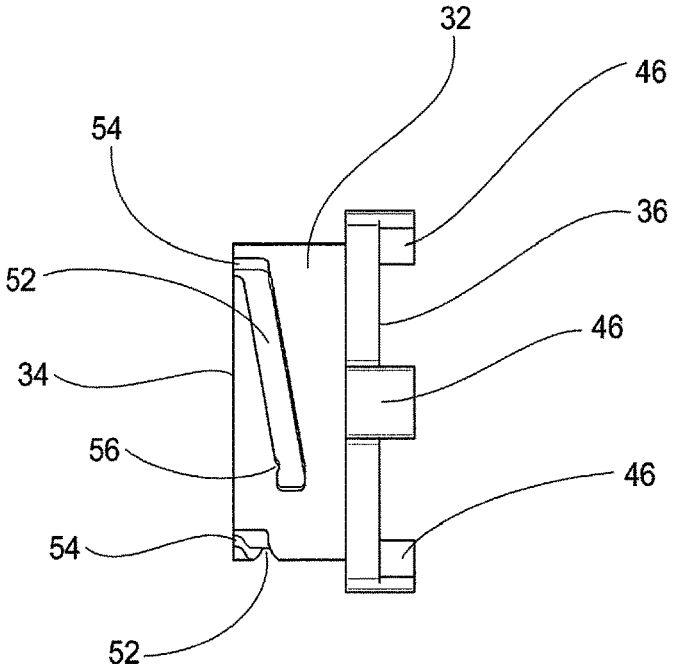
FIG. 12 is a right side view of the end-of-car connector body of FIG. 11 according to one aspect of the present invention.
Figure 13:
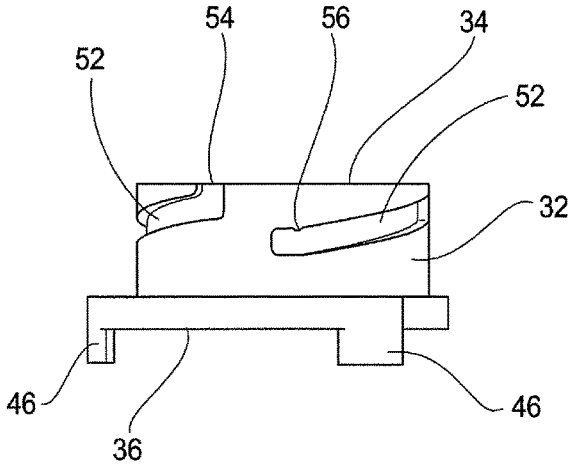
FIG. 13 is a bottom view of the end-of-car connector body of FIG. 11 according to one aspect of the present invention.
Figure 14:
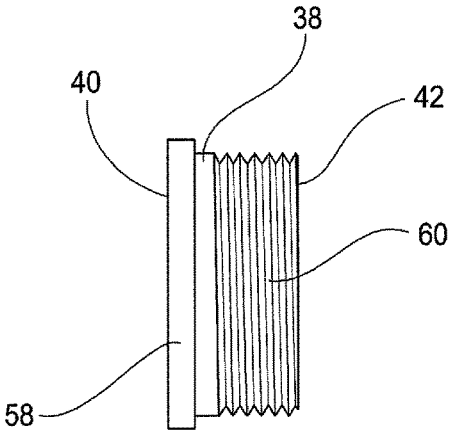
FIG. 14 is a right side view of a threaded member according to one aspect of the present invention.
Figure 15:
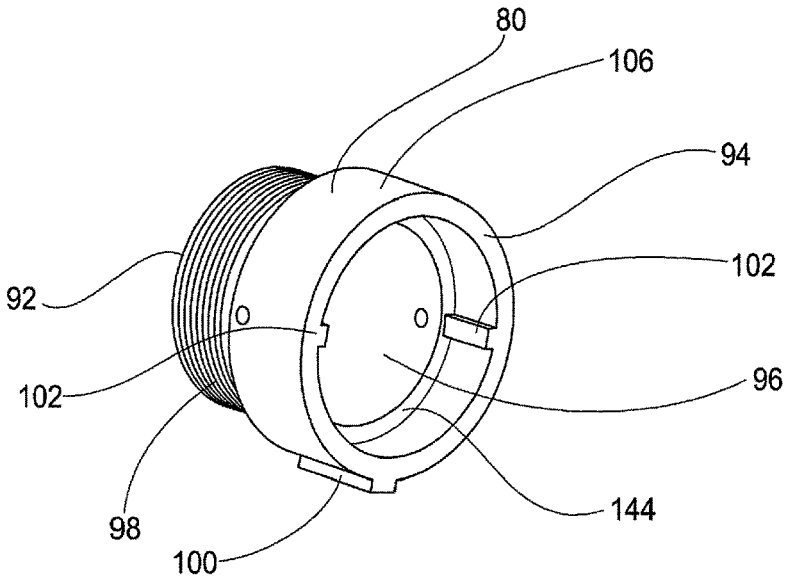
FIG. 15 is a perspective view of a cable connector body according to one aspect of the present invention.
Figure 16:
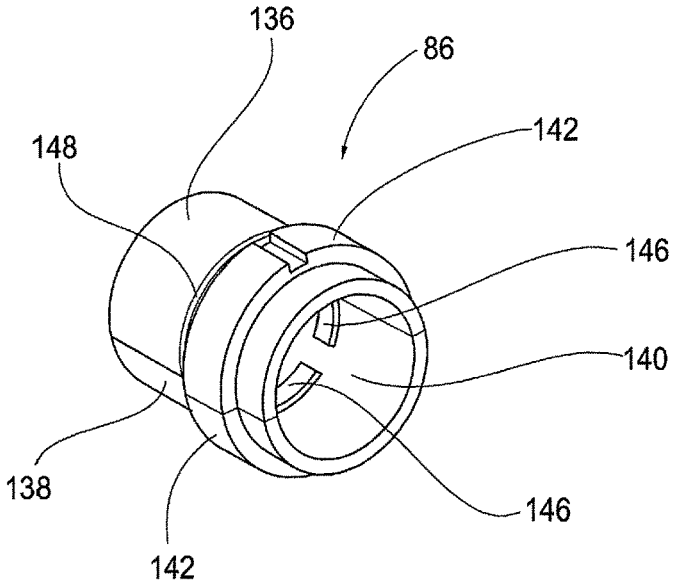
FIG. 16 is a perspective view of a clamp assembly according to one aspect of the present invention.
Figure 17:
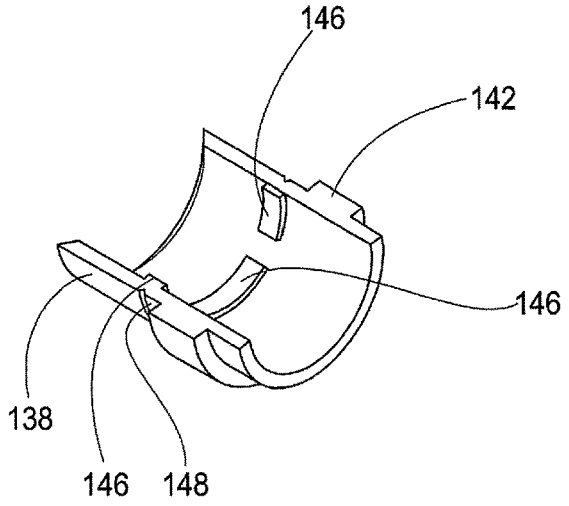
FIG. 17 is a perspective view of a clamp member of the clamp assembly of FIG. 16 according to one aspect of the present invention.
Figure 18:
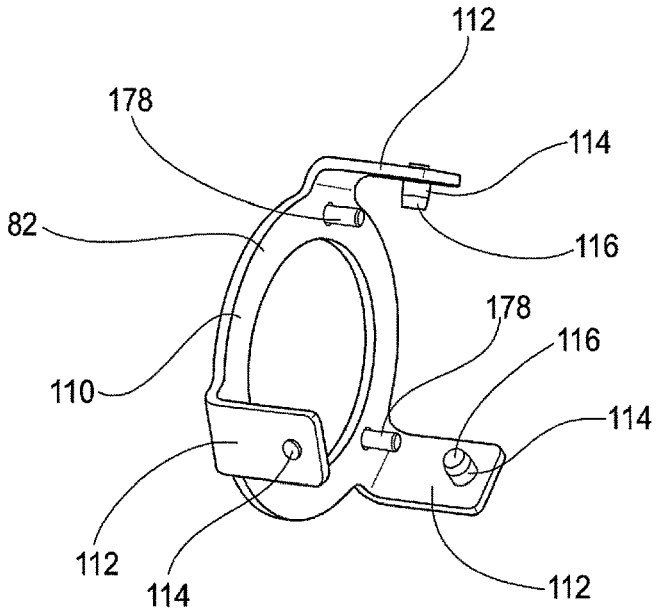
FIG. 18 is a perspective view of a spring member according to one aspect of the present invention.
Figure 19:
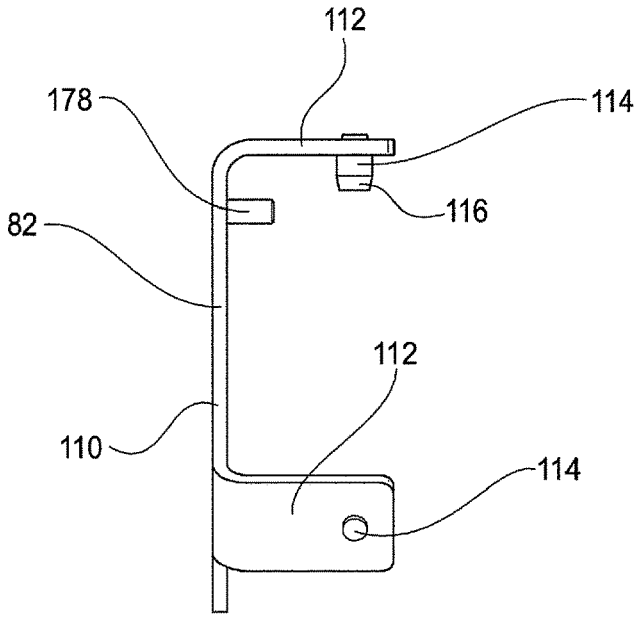
FIG. 19 is a right side view of the spring member of FIG. 18 according to one aspect of the present invention.
Figure 20:
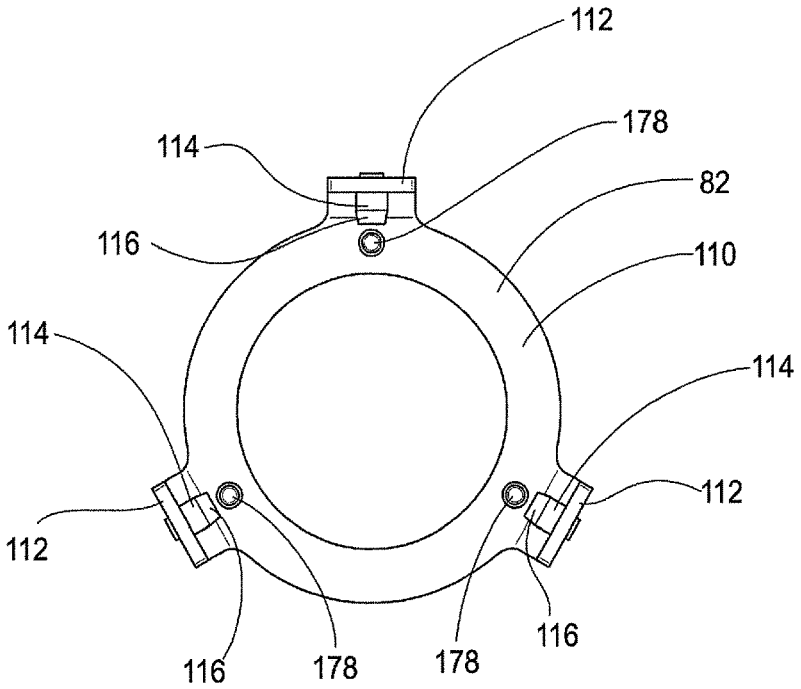
FIG. 20 is a bottom view of the spring member of FIG. 18 according to one aspect of the present invention.

As shown more clearly in FIGS. 11-13, and in one preferred and non-limiting embodiment or aspect, the EOC connector body 32 defines a plurality of securing recesses 52. The securing recesses 52 each include an opening 54 at the first end 34 of the EOC connector body 32 and are L-shaped, bayonet-style recesses, although other suitable shapes and arrangements for the recesses 52 may be utilized. The securing recesses 52 are configured to receive a mating portion of the cable connector assembly 22 as discussed in more detail below. The securing recesses 52 also each include a locking detent 56 that are configured to receive and secure a mating portion of the cable connector assembly 22 within the securing recesses 52. The threaded member 38 includes a flange 58 projecting radially outward from the first end 40 of the threaded member 38 and a threaded portion 60 configured to mate with a corresponding threaded portion 62 of the EOC fitting 14. As shown more clearly in FIG. 6, the flange 58 of the threaded member 38 is configured to engage a flange 64 of the EOC connector body 32 that extends radially inwardly.

Referring to FIGS. 1-3, 5, and 6, and in one preferred and non-limiting embodiment or aspect, the EOC connector body 32 is installed on the EOC fitting 14 by positioning the second end 36 of the EOC connector body 32 against the EOC fitting 14 with the central passageway 44 of the EOC connector body 32 aligned with a passageway of the EOC fitting 14. The projections 46 of the EOC connector body 32 are positioned to engage the flat portions 48 of the EOC fitting 14, which rotationally fixes the EOC connector body 32 relative to the EOC fitting 14 and orients the EOC connector body 32 relative to the female pin body 28. The EOC connector body 32 is secured to the EOC fitting 14 by positioning the threaded member 38 through the central passageway 44 of the EOC connector body 32 and engaging the threaded portion 62 of the EOC fitting 14 with the threaded portion 60 of the threaded member 38 with the flange 58 of the threaded member 38 engaging the flange 64 of the EOC connector body 32. The threaded member 38 includes a plurality of tool interfaces 66 configured to receive a tool to tighten and secure the threaded member 38 to the EOC fitting 14.

Referring to FIGS. 4-10 and 15-20, and in one preferred and non-limiting embodiment or aspect, the cable connector assembly 22 includes a cable connector body 80, a spring member 82, a coupler ring 84, a clamp assembly 86, a rear nut 88, and an outer housing 90. The cable connector body 80 has a first end 92 and a second end 94 and defines a central opening 96 configured to receive a portion of the cable 12. The first end 92 of the cable connector body 80 includes a threaded portion 98 configured to receive the rear nut 88. The cable connector body 80 also includes an outer key 100 extending radially outward from the cable connector body 80. The outer key 100 of the cable connector body 80 is configured to be received by the key recess 50 of the EOC connector body 32. The outer key 100 is a rectangular projection, although other suitable shapes and arrangements may be utilized. The cable connector body 80 further includes inner keys 102 extending radially inward from the cable connector body 80 into the central opening 96. The inner keys 102 are configured to be received by key recesses 104 defined by the clamp assembly 86 as discussed below. The inner keys 102 are a rectangular projection, although other suitable shapes and arrangements may be utilized. The cable connector body 80 includes a protruding portion 106 adjacent to the second end 94 of the cable connector body 80. The protruding portion 106 extends further radially outward than a portion of the cable connector body 80 adjacent to the first end 92 of the cable connector body 80.

Referring to FIGS. 4 and 18-20, and in one preferred and non-limiting embodiment or aspect, the spring member 82 has an annular body 110 with a plurality of extensions 112 extending from the annular body 110. The spring member 82 also includes a plurality of protrusions 114 positioned on each of the extensions 112. Although three protrusions 114 and three extensions 112 are shown, one or more protrusions 114 and extensions 112 may be provided. As shown more clearly in FIGS. 18-20, the protrusions 114 are embodied as pins having a tapered portion 116. The protrusions 114 of the spring member 82 extend radially inward and are moveable relative to the cable connector body 80 via the extensions 112 in a radial direction. The protrusions 114 of the spring member 82 are moveable relative to the cable connector body 80 between a locked position where the protrusions 114 are configured to be secured to a mating connector, such as the EOC connector body 32, and a released position where the protrusions 114 are configured to be released from a corresponding recess of a mating connector, such as the securing recesses 52 of the EOC connector body 32. The protrusions 114 are moveable from the locked position to the released position upon a predetermined axial force applied to the spring member 82 as discussed in more detail below. The spring member 82 is also rotatable relative to the cable connector body 80 and the cable 12 to secure the cable connector assembly 22 to the EOC connector assembly 20. In particular, the spring member 82 and the protrusions 114 rotate to guide the protrusions 114 into and along the securing recesses 52 of the EOC connector body 32 to secure the cable connector assembly 22 to the EOC connector assembly 20.

Referring to FIGS. 4-10 and 15-20, and in one preferred and non-limiting embodiment or aspect, the coupler ring 84 defines a central opening 120 configured to receive the cable connector body 80. The coupler ring 84 includes a first end 122 and a second end 124 with an inwardly extending flange 126 positioned adjacent to the first end 122. The inwardly extending flange 126 is configured to be positioned between the protruding portion 106 of the cable connector body 80 and the rear nut 88. In particular, the inwardly extending flange 126 of the coupler ring 84 will be sandwiched between the protruding portion 106 of the cable connector body 80 and the rear nut 88 upon assembly of the cable connector assembly 22 to the cable 12. The coupler ring 84 defines a plurality of openings 128 that are configured to receive the protrusions 114 of the spring member 82. The coupler ring 84 is configured to be secured to the spring member 82 and also rotatable relative to the cable connector body 80 as discussed in more detail below.

Referring to FIGS. 4, 6, 16, and 17, and in one preferred and non-limiting embodiment or aspect, the clamp assembly 86 includes first and second clamp members 136, 138. The first and second clamp members 136, 138 are joined to form the clamp assembly 86 and each form one half of the clamp assembly 86. When joined together, the first and second clamp members 136, 138 form a central passageway 140 that is configured to receive the cable 12. The first and second clamp members 136, 138 each define the key recess 104 on an outer surface of the clamp members 136, 138 that extend in a longitudinal direction of the first and second clamp members 136, 138. The key recesses 104 are rectangular and configured to cooperate with the inner keys 102 of the cable connector body 80, although other suitable shapes and arrangements may be utilized for the key recesses 104. The first and second clamp members 136, 138 each include a flange 142 extending radially outward from the first and second clamp members 136, 138. The key recesses 104 are defined by the flanges 142, although other suitable positions for the key recesses 104 may be utilized. The flanges 142 of the first and second clamp members 136, 138 are configured to engage an internal abutment 144 of the cable connector body 80 positioned opposite of the protruding portion 106 of the cable connector body 80. The first and second clamp members 136, 138 each include lock members 146 that project radially inward from the first and second clamp members 136, 138. The lock members 146 are rectangular projections extending circumferentially and are configured to engage the cable 12 to secure the clamp members 136, 138 relative to the cable 12, although other suitable shapes and arrangements may be utilized for the lock members 146. The first and second clamp members 136, 138 also each define annular recesses 148 on an outer surface of the clamp members 136, 138 opposite from the lock members 146. The annular recesses 148 are configured to receive a pair of set screws 150 to secure the clamp members 136, 138 to the cable 12 as discussed in more detail below.

Referring to FIGS. 1, 2, and 4-10, and in one preferred and non-limiting embodiment or aspect, the rear nut 88 defines a central opening 154 and a flange 156 extending radially inward. The rear nut 88 includes a threaded portion 158 configured to receive and engage the threaded portion 98 of the cable connector body 80. The rear nut 88 includes a drive surface 160 configured to receive a tool for securing the rear nut 88 onto the cable connector body 80. The cable connector assembly 22 also includes a rear seal 162 that is configured to be received by the rear nut 88 and form a seal against the cable 12. The rear seal 162 includes a tapered portion 164 that is configured to engage corresponding tapered portions 166 of the first and second clamp members 136, 138.

Referring again to FIGS. 1, 2, and 4-10, and in one preferred and non-limiting embodiment or aspect, the outer housing 90 includes a body 170 and front cap 172. The outer housing 90 is configured to be positioned about and secured to the spring member 82 and the coupler ring 84. The outer housing 90 is formed from an elastomer, although other suitable materials may be utilized. The outer housing 90 includes a plurality of grip protrusions 174 to facilitate gripping and movement of the outer housing 90, the coupler ring 84, and the spring member 82. The outer housing 90 may be overmolded onto the coupler ring 84, although other suitable arrangements may be utilized.

Although the cable connector assembly 22 includes the spring member 82 and the EOC connector assembly 20 includes the securing recesses 52, the EOC connector assembly 20 may include the spring member 82 with the cable connector assembly 22 including the securing recesses 52. Further, although the protrusions 114 of the spring member 82 extend radially inward and the securing recesses 52 of the EOC connector body 32 are provided on an outer surface of the EOC connector body 32, the protrusions 114 may extend radially outward with the securing recesses 52 provided on an inner surface of the EOC connector body 32.

Referring to FIGS. 1, 2, and 4-10, and in one preferred and non-limiting embodiment or aspect, the cable connector assembly 22 is installed onto the cable 12 by threading the rear nut 88, the rear seal 162, the outer housing 90, the spring member 82, the coupler ring 84, and the cable connector body 80 over the flanged end 24 of the cable 12. The first and second clamp members 136, 138 of the clamp assembly 86 are placed onto the cable 12 with the first and second clamp members 136, 138 abutting the flanged end 24 of the cable 12. The first and second clamp members 136, 138 may include an adhesive film applied to the clamp members 136, 138 to secure them in place prior to remaining steps of the installation of the cable connector assembly 22, although other securing arrangements for the clamp members 136, 138 may also be utilized.

In one preferred and non-limiting embodiment or aspect, the cable connector body 80 is positioned over the first and second clamp members 136, 138, which compresses the clamp members 136, 138 due to the relative dimensions of the cable connector body 80 and the clamp members 136, 138. Prior to positioning the cable connector body 80, however, the outer key 100 of the cable connector body 80 is oriented relative to the pins 26 of the cable 12 and the key recess 50 of the EOC connector body 32. More specifically, the pins 26 of the cable 12 are aligned with the female pin body 28 of the EOC fitting 14 to facilitate a proper connection between the pins 26 and the female pin body 28 and then the outer key 100 of the cable connector body 80 is rotated until the outer key 100 is aligned with the key recess 50 of the EOC connector body 32, which will ensure a proper connection between the cable 12 and the EOC fitting 14 when the cable connector assembly 22 is secured to the EOC connector assembly 20. When compressed, the lock members 146 of the first and second clamp members 136, 138 engage the cable 12 and secures the first and second clamp members 136, 138 to the cable 12. The flanged end 24 of the cable 12 is typically made from an elastomeric material such that the first and second clamp members 136, 138 imprint into the flanged end 24 of the cable 12 when compressed. The inner keys 102 of the cable connector body 80 are received by the key recesses 104 of the first and second clamp members 136, 138 to rotationally fix the cable connector body 80 relative to the clamp assembly 86. The flanges 142 of the first and second clamp members 136, 138 engage the internal abutment 144 of the cable connector body 80 to prevent further axial movement of the cable connector body 80 past the clamp assembly 86. With the outer key 100 of the cable connector body 80 properly aligned, as described above, the set screws 150 are positioned through openings in the cable connector body 80 and are tightened until the set screws 150 engage the annular recesses 148 of the first and second clamp members 136, 138 thereby locking the cable connector body 80 relative to the clamp members 136, 138 and the cable 12 and further compressing the first and second clamps 136, 138.

In one preferred and non-limiting embodiment or aspect, the spring member 82 and the outer housing 90 are positioned about and secured to the coupler ring 84 with the protrusions 114 extending through the openings 128 of the coupler ring 84. The spring member 82 is secured to the coupler ring 84 via a plurality of fasteners 178, such as screws, although other suitable securing arrangements may be utilized. The spring member 82 and the outer housing 90 may be secured to the coupler ring 84 prior to positioning the spring member 82 and coupler ring 84 over the flanged end 24 of the cable 12. The outer housing 90, the spring member 82, and the coupler ring 84 are moved along the cable 12 toward the flanged end 24 of the cable 12 until the coupler ring 84 abuts the protruding portion 106 of the cable connector body 80. The rear seal 162 is slid into position against the first and second clamp members 136, 138 with the tapered portion 164 of the rear seal 162 engaged with the tapered portions 166 of the first and second clamp members 136, 138. The rear nut 88 is then moved along the cable 12 towards the flanged end 24 of the cable 12 and secured to the threaded portion 98 of the cable connector 80 to secure the spring member 82, the outer housing 90, and the coupler ring 84 to the cable connector body 80 while still allowing the spring member 82, the outer housing 90, and the coupler ring 84 to rotate relative to the cable connector body 80. The outer housing 90 and the rear seal 162 abuts and forms a seal with the rear nut 88.

Referring to FIGS. 1-6, and in one preferred and non-limiting embodiment or aspect, the cable connector assembly 22 can be readily connected to and disconnected from the EOC connector assembly 20 and also provide a breakaway feature to allow the cable 12 to release from the EOC fitting 14 upon a predetermined axial force applied to the spring member 82 via the cable 12. The cable connector assembly 22 is connected to the EOC connector assembly 20 by aligning the outer key 100 of the cable connector body 80 with the key recess 50 of the EOC connector body 32 and advancing the flanged end 24 of the cable 12 into the EOC connector body 32. The outer housing 90, the coupler ring 84, and the spring member 82 are rotated clockwise relative to the cable connector body 80 onto the EOC connector body 32 with the protrusions 114 of the spring member 82 received by the respective openings 54 of the securing recesses 52 of the EOC connector body 32. The outer housing 90, the coupler ring 84, and the spring member 82 are rotated until the protrusions 114 reach the end of the securing recesses 52. The protrusions 114 move past the locking detent 56 to provide a tactile and/or audible indication that the cable connector assembly 22 is secured to the EOC connector assembly 20. As the outer housing 90, the coupler ring 84, and the spring member 82 are being rotated onto the EOC connector body 32, the cable connector body 80 and the cable 12 are moved axially within the EOC connector body 32 and EOC fitting 14 with the pins 26 of the cable 12 being received by the female pin body 28 of the EOC fitting 14. The pins 26 of the cable 12 will be fully connected to the female pin body 28 of the EOC fitting 14 when the protrusions 114 move past the locking detent 56 of the securing recesses 52. With the spring member 82 and the protrusions 114 in the locked position, the outer housing 90 is engaged with the EOC connector body 32 to form a seal therebetween. Accordingly, the outer housing 90 and the rear seal 162 provide a sealed connection between the cable connector assembly 22 and the EOC connector assembly 20 to prevent the infiltrations of water or debris into the railcar power connector assembly 10.

In one preferred and non-limiting embodiment or aspect, if a predetermined axial force is applied to the cable 12 with the cable connector assembly 22 connected to the EOC connector assembly 20, the spring member 82 will transition from the locked position, where the protrusions 114 are secured within the securing recesses 52 of the EOC connector body 32, to a released position, where the protrusions 114 are released from the securing recesses 52 of the EOC connector body 32. In particular, the predetermined axial force causes the protrusions 114 of the spring member 82 to engage the EOC connector body 32 and bias the spring member 82 radially outward until the protrusions 114 are completely free from the securing recesses 52 thereby releasing the cable connector assembly 22 from the EOC connector assembly 20. The tapered portions 116 of the protrusions 114 facilitate the radially outward movement of the spring member 82 in response to the predetermined axial force. The predetermined axial force may be 800 lbs, although other suitable predetermined axial forces may be selected by modifying the materials and/or shape of the spring member 82 to change the force required to move the spring member 82 radially outward. This breakaway feature prevents damage to the cable 12, the cable connector assembly 22, and/or the EOC connector assembly 20 should the inter-car connection (not shown) of the cable fail to disconnect upon separation of the railcars. After the cable connector assembly 22 is released from the EOC connector assembly 20 during a breakaway separation, the cable connector assembly 22 may be readily reconnected to the EOC connector assembly 20 using the same method as described above. Accordingly, the railcar power connector assembly 10 provides a simplified arrangement for connecting the cable 12 to the EOC fitting 14 and reconnecting the cable 12 to the EOC fitting 14 after a breakaway separation.

Referring again to FIGS. 1-6, and in one preferred and non-limiting embodiment or aspect, the cable connector assembly 22 is removed from the EOC connector assembly 20 by reversing the steps mentioned above for connecting the cable connector 22 assembly to the EOC connector assembly 20. In particular, the outer housing 90, the spring member 82, and the coupler ring 84 are rotated counterclockwise with the protrusions 114 moving toward the first end 40 of the EOC connector body 32 within the securing recesses 52 until the protrusions 114 exit the openings 54 and are removed from the securing recesses 52. The cable connector assembly 22 is simultaneously moved axially away from the EOC connector assembly 20 to disconnect the pins 26 of the cable 12 from the female pin body 28 of the EOC fitting 14.

Referring to FIGS. 21-39, a railcar power connector assembly 210 for attaching a cable 12 to an EOC fitting 14 according to another aspect is shown. The railcar power connector assembly 210 is similar to the railcar power connector assembly 10 shown in FIGS. 1-20 and discussed above and will operate in the same manner. In one preferred and non-limiting embodiment or aspect, the railcar power connector assembly 210 includes an EOC connector assembly 220 for installation on the EOC fitting 14 and a cable connector assembly 222 for installation on the cable 12. Although the railcar power connector assembly 210 is shown and described as modifying an existing cable and EOC fitting, the features of the assembly 10 may also be incorporated into the design of the cable 12 and EOC fitting 14 during their respective manufacture. The cable 12 includes a flanged end 24 that receives a plurality of contacts or pins 26 configured to mate with a corresponding contact to establish electrical contact therebetween. In particular, the EOC fitting 14 includes a female pin body 28 that receives the plurality of pins 26 from the cable 12 when the cable connector assembly 222 is connected to the EOC connector assembly 220 as discussed above in connection with the railcar power connector assembly 10.

Referring to FIGS. 32-39, and in one preferred and non-limiting embodiment or aspect, the EOC connector assembly 220 includes an EOC connector body 232 and a threaded member 238. The EOC connector body 232 and the threaded member 238 are similar to the EOC connector body 32 and the threaded member 38 described above and shown in FIGS. 1-20, expect for the differences described below. In particular, rather than providing a plurality of projections 46 integral with the EOC connector body 32, the EOC connector assembly 232 includes an index washer 230 having a projection 246 that works in a similar manner as the projections 46, as discussed above. The index washer 230 allows all mounting orientations of the EOC connector assembly 220 to the EOC fitting 14. Different configurations of the index washer 230 may be utilized for various style EOC fittings 14. For example, the index washer 230 may accommodate a WABTEC EOC fitting with another index washer 230 configuration designed to accommodate a New York Air Brake EOC fitting. The index washer 230 is annular and includes a plurality of recesses 233 that receive corresponding projections 235 on the EOC connector body 232 to rotationally fix the index washer 230 relative to the EOC connector body 232. The EOC connector assembly 232 also includes an O-ring 253 received within a groove 251 defined by the EOC connector body 232. The threaded member 238 is similar to the threaded member 38, except that the tool interfaces 266 are elongated, arcuate openings defined by the threaded member 238. The tool interfaces 266 engage corresponding shaped projections 268 of a drive tool 270, shown in FIGS. 38 and 39.

Figure 35:
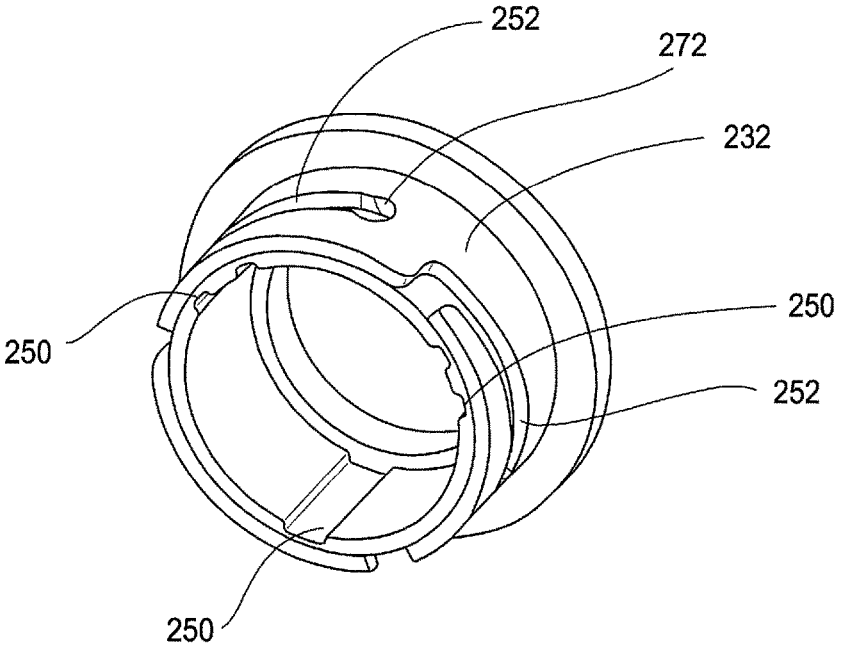
FIG. 35 is a bottom perspective view of an end-of-car connector body according to one aspect of the present invention.
Figure 36:
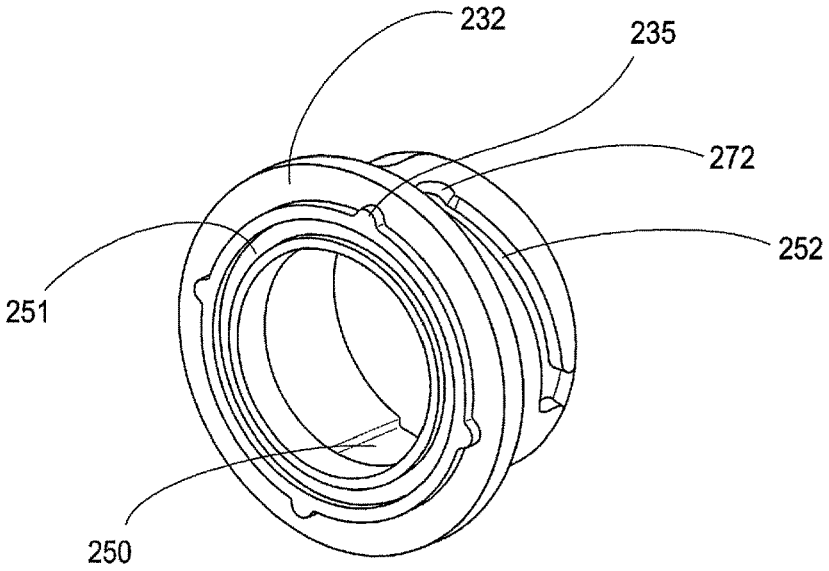
FIG. 36 is a top perspective view of the end-of-car connector body of FIG. 35 according to one aspect of the present invention.
Figure 37:
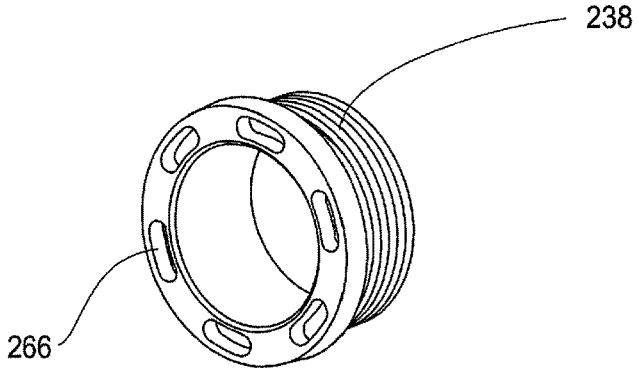
FIG. 37 is a perspective view of a threaded member according to one aspect of the present invention.
Figure 38:
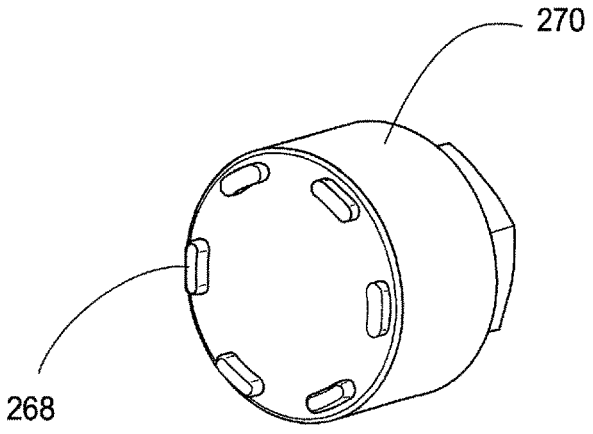
FIG. 38 is a top perspective view of a drive tool according to one aspect of the present invention.
Figure 39:
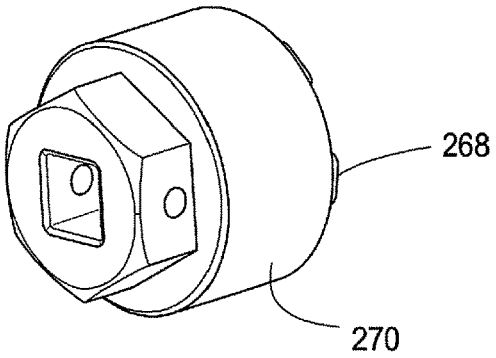
FIG. 39 is a bottom perspective view of the drive tool of FIG. 38 according to one aspect of the present invention.

Referring to FIGS. 35 and 36, the EOC connector body 232 also defines a plurality of key recesses 250 to receive corresponding keys from the cable connector assembly 222, rather than the single key recess 50 as discussed above in connection with EOC connector body 32. The key recesses 250 are rectangular channels, although other suitable arrangements may be utilized. As shown in FIG. 35, the EOC connector body 232 includes five key recesses 250 spaced circumferentially around the EOC connector body 232 with two sets arranged as pairs and a single recess 250 provided alone. The EOC connector body 232 also defines a plurality of securing recesses 252, which generally function in the same manner as the securing recesses 52 discussed above. The securing recesses 252, however, include a tapered surface 272 at the end of each of the securing recesses 252 that cooperate with a mating portion of the cable connector assembly 222 as discussed in more detailed below. The tapered surface 272 may have about a 10 degree draft angle, although other suitable draft angles may be utilized.

Referring to FIGS. 32-39, and in one preferred and non-limiting embodiment or aspect, the EOC connector body 232 is installed on the EOC fitting 14 by positioning the index washer 230 and the EOC connector body 232 against the EOC fitting 14. The projection 246 of the index washer 230 is positioned to engage the flat portions 48 of the EOC fitting 14, which orients the EOC connector body 232 relative to the female pin body 28. The EOC connector body 232 is secured to the EOC fitting 14 by positioning the threaded member 238 through the EOC connector body 232 and threading the threaded member 238 into the EOC fitting 14 in the same manner as described above in connection with EOC connector body 32. The drive tool 270, shown in FIGS. 38 and 39, may be used to tighten and secure the threaded member 238 to the EOC fitting 14.

Referring to FIGS. 22-31, and in one preferred and non-limiting embodiment or aspect, the cable connector assembly 222 includes a cable connector body 280, spring members 282, a coupler ring 284, a clamp assembly 286, a rear cover 288, and an outer housing 290. The cable connector body 280, the spring members 282, the coupler ring 284, the clamp assembly 286, the rear cover 288, and the outer housing 290 are similar to and generally operate in the same manner as the connector body 80, the spring member 82, the coupler ring 84, the clamp assembly 86, the rear nut 88, and the outer housing 90 discussed above and shown in FIGS. 1-20. Rather than providing a cooperating threaded arrangement between the rear cover 288 and the cable connector body 280, the rear cover 288 is secured to the cable connector body 280 via a plurality of fasteners 380, such as screws, although other suitable securing arrangements may be utilized. The cable connector body 280 also includes outer keys 300 extending radially outward from the cable connector body 280. The outer keys 300 of the cable connector body 280 are configured to be received by the key recesses 250 of the EOC connector body 232. The outer keys 300 are rectangular projections, although other suitable shapes and arrangements may be utilized. The cable connector body 280 includes five outer keys 300 spaced circumferentially around the cable connector body 280 with two sets arranged as pairs and a single outer key 300 provided alone, which are configured to be received by the correspondingly arranged key recesses 250. The cable connector body 280 further includes inner keys 302 extending radially inward from the cable connector body 280. The inner keys 302 are configured to be received by key recesses 304 defined by the clamp assembly 286 in the same manner as discussed above in connection with clamp assembly 86. The cable connector body 280 may be injection molded from a plastic material, although other suitable materials and manufacturing arrangements may be utilized.

Referring to FIGS. 26-31, and in one preferred and non-limiting embodiment or aspect, the spring members 282 each include a body 310 having an L-shape secured to the coupler ring 284 via fasteners 378, such as screws, although other suitable securing arrangements may be utilized. A portion of the body 310 also extends through an opening in the coupler ring 284 adjacent to the fasteners 378. The spring members 282 also each include protrusions 314. As shown more clearly in FIGS. 30-31, the protrusions 314 are embodied as pins, although other suitable arrangements may be utilized. The protrusions 314 of the spring members 282 extend radially inward and are moveable relative to the cable connector body 280 in a radial direction. In particular, the spring members 282 are fixed to the coupler ring 284 at one end and are free at the other end with the protrusions 314 such that the spring members 282 define a cantilever spring arrangement.

The spring members 282 operate in the same manner as the spring member 82 discussed above in connection with FIGS. 1-20. However, instead of providing a tapered surface on the protrusions 314, the securing recesses 252 include the tapered surface 272 such that the protrusions 314 are moveable from a locked position to a released position with respect to the EOC connector assembly 220 upon a predetermined axial force applied to the spring members 282. The spring members 282 are also rotatable relative to the cable connector body 280 and the cable 12 to secure the cable connector assembly 222 to the EOC connector assembly 220. In particular, the spring members 282 and the protrusions 314 rotate to guide the protrusions 314 into and along the securing recesses 252 of the EOC connector body 232 to secure the cable connector assembly 222 to the EOC connector assembly 220 in the same manner as discussed above in connection with the EOC connector body 32 and the cable connector assembly 22. The predetermined axial force required to move the spring members 282 from the locked position to the released position may be tuned by changing the length of the protrusions 314 and/or providing a recessed portion at the securing recesses 252 to reduce the radial distance the protrusions 314 need to move to exit the securing recesses 252.

Referring again to FIGS. 26-31, and in one preferred and non-limiting embodiment or aspect, the coupler ring 284 defines a central opening 320 configured to receive the cable connector body 280. The coupler ring 284 includes an inwardly extending flange 326 for receiving the cable connector body 280. In particular, the inwardly extending flange 326 of the coupler ring 284 will be sandwiched between a portion of the cable connector body 280 and the rear cover 288 upon assembly of the cable connector assembly 222 to the cable 12. The coupler ring 284 defines a plurality of openings 328 that are configured to receive the protrusions 314 of the spring members 282. The coupler ring 284 may be manufactured from aluminum, although other suitable materials may be utilized.

Figure 23:
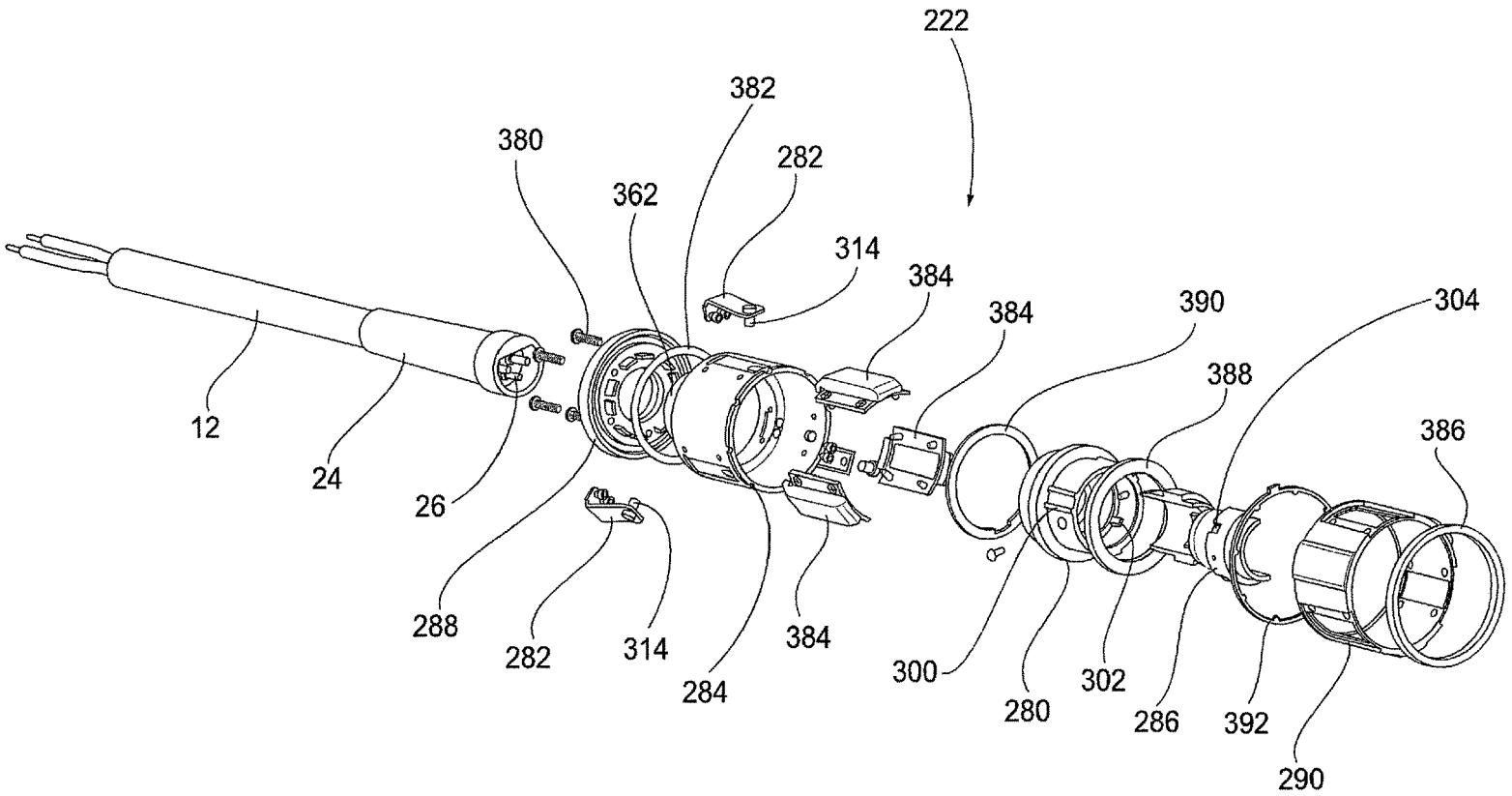
FIG. 23 is an exploded perspective view of the assembly of FIG. 22 according to one aspect of the present invention.
Figure 24:
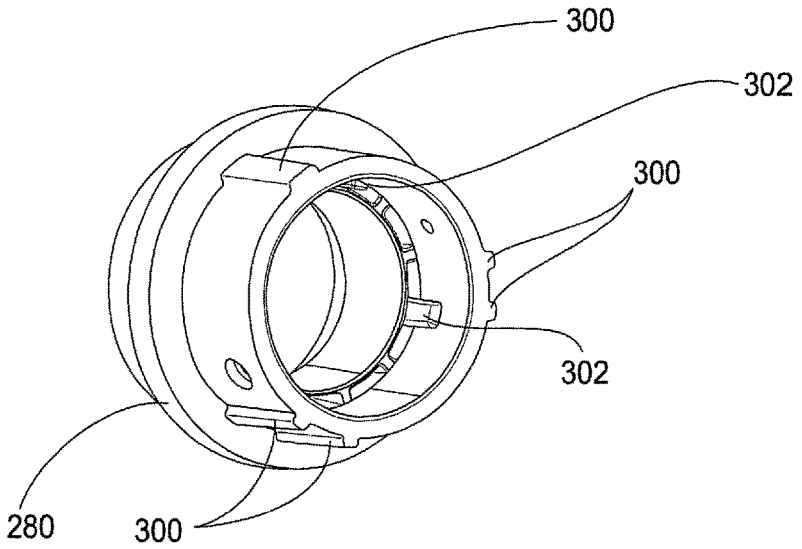
FIG. 24 is a top perspective view of a cable connector body according to one aspect of the present invention.
Figure 25:
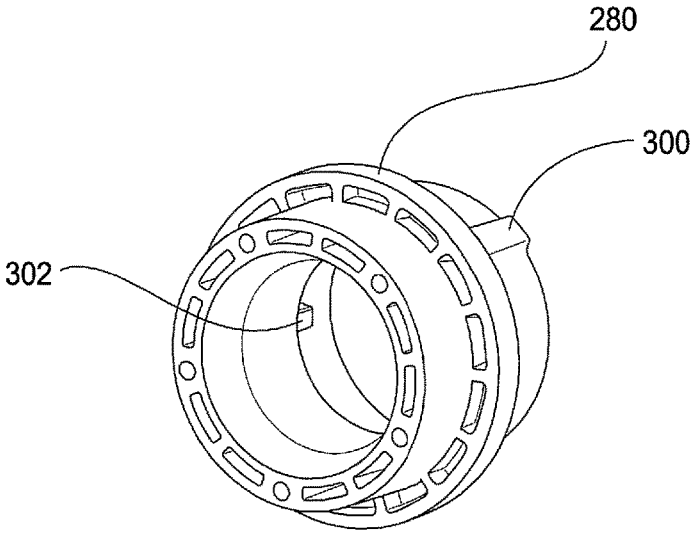
FIG. 25 is a bottom perspective view of the cable connector body of FIG. 24 according to one aspect of the present invention.
Figure 26:
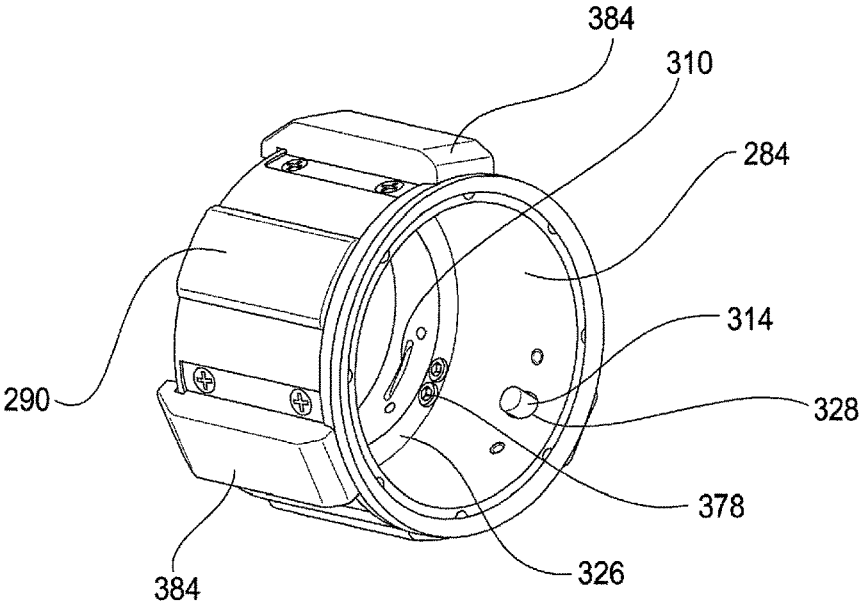
FIG. 26 is a perspective view of a coupler ring assembly according to one aspect of the present invention.
Figure 27:
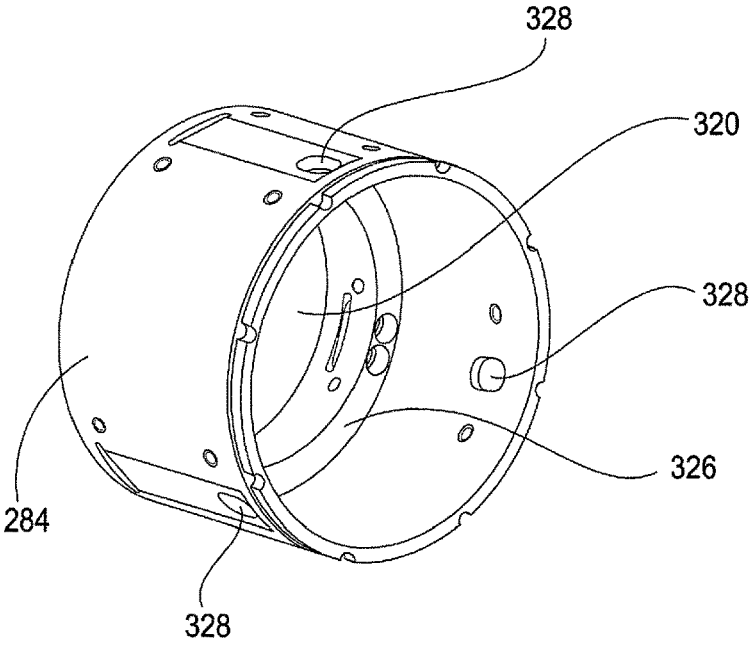
FIG. 27 is a perspective view of the coupler ring of FIG. 26 according to one aspect of the present invention.
Figure 28:
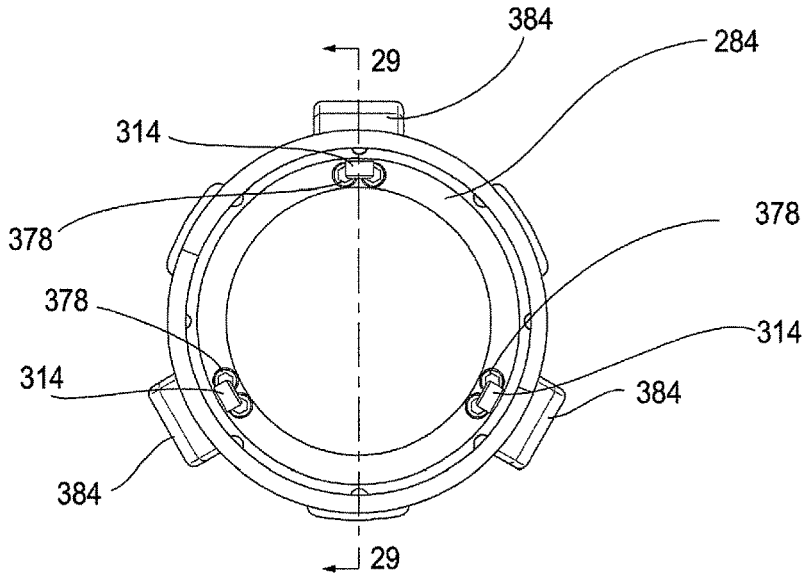
FIG. 28 is a top view of the coupler ring assembly according to one aspect of the present invention.
Figure 29:
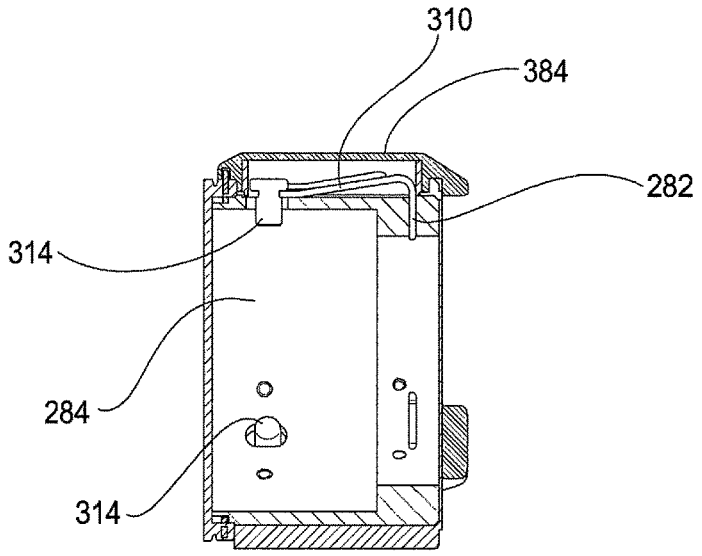
FIG. 29 is a cross-sectional view along line 29-29 shown in FIG. 28 according to one aspect of the present invention.
Figure 30:
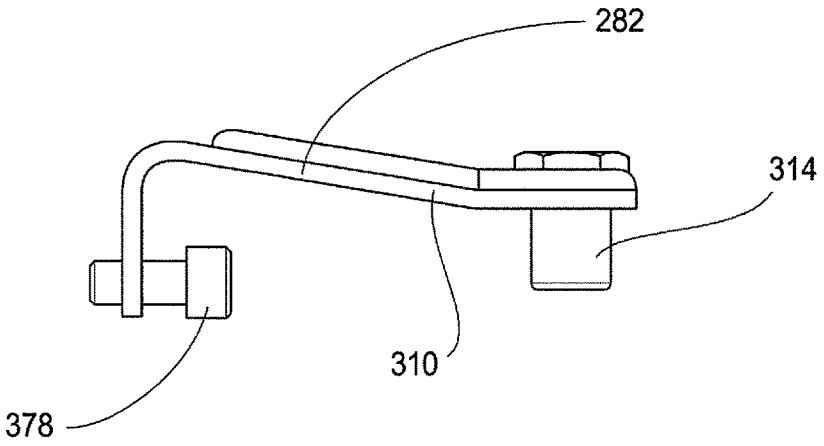
FIG. 30 is a right side view of a spring member according to one aspect of the present invention.
Figure 31:
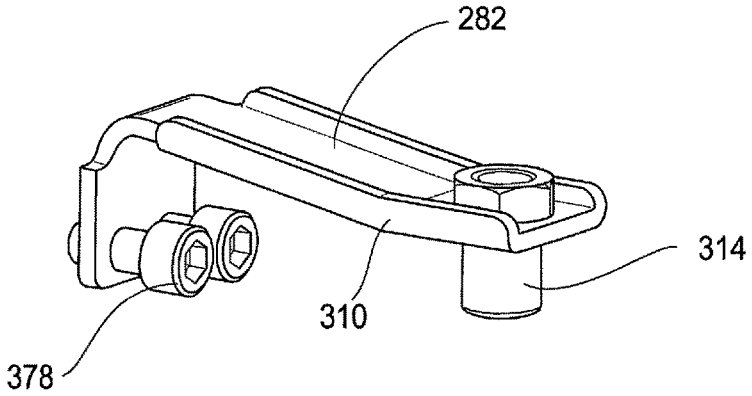
FIG. 31 is a perspective view of the spring member of FIG. 30 according to one aspect of the present invention.
Figure 32:
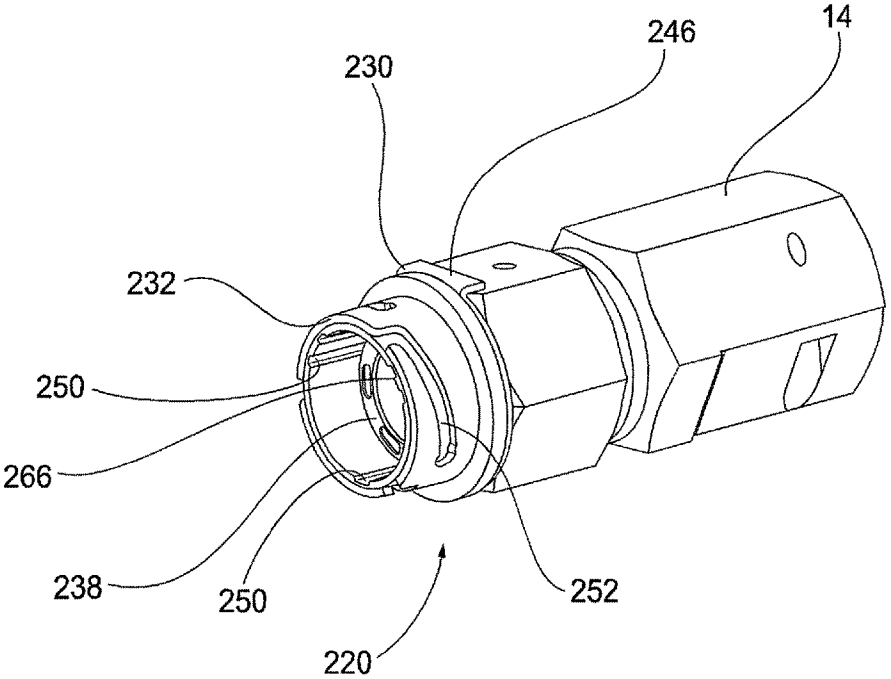
FIG. 32 is a perspective view of an end-of-car connector assembly according to one aspect of the present invention.
Figure 33:
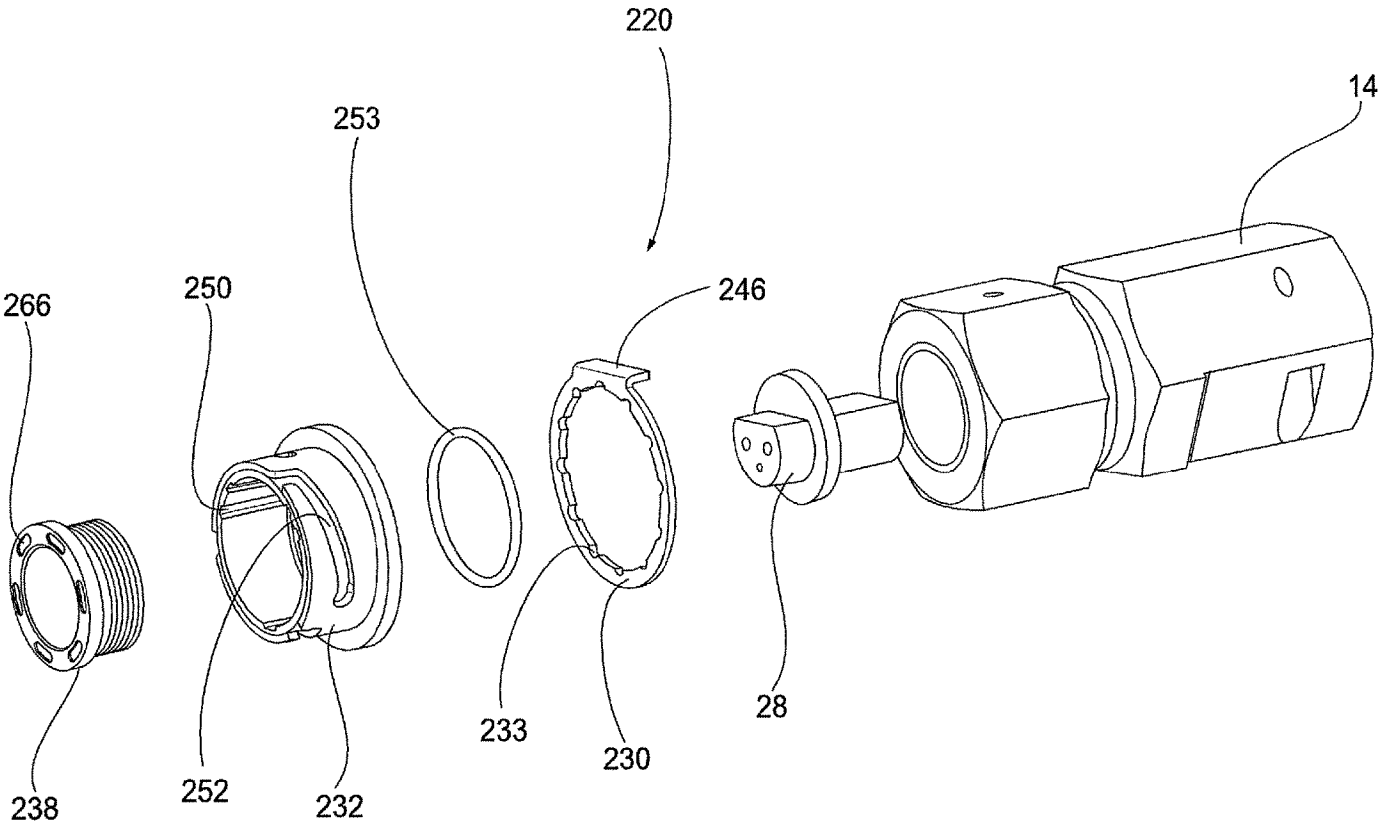
FIG. 33 is an exploded perspective view of the end-of-car connector assembly shown in FIG. 32 according to one aspect of the present invention.
Figure 34:
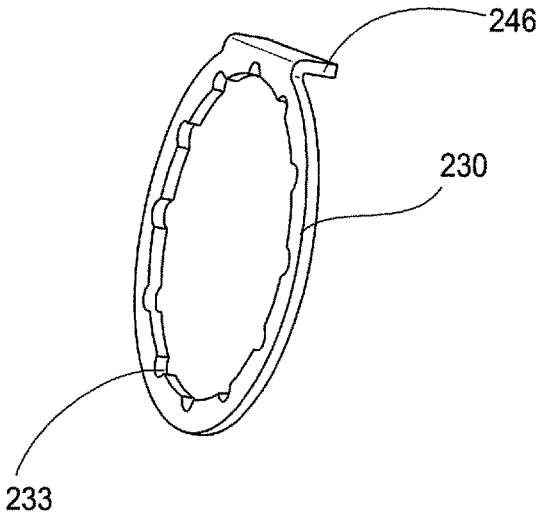
FIG. 34 is a perspective view of an index washer according to one aspect of the present invention.

Referring to FIG. 23, and in one preferred and non-limiting embodiment or aspect, the clamp assembly 286 is similar to and operates in the same manner as the clamp assembly 86 shown in FIGS. 1-20 and discussed above. Further, the cable connector assembly 222 also includes a rear seal 362 positioned between the rear cover 288 and the cable connector body 280. The rear seal 362 seals the cable connector assembly 222 and also functions as a cable grip by squeezing around the cable 12 when the rear cover 288 is fully tightened down to force the rear seal 362 into a tapered portion of the cable connector body 280. The cable connector assembly 222 also includes an O-ring 382 received by the rear cover 288, which engages and forms a seal with the coupler ring 284.

Referring to FIGS. 21-23 and 26, and in one preferred and non-limiting embodiment or aspect, the outer housing 290 is similar to the outer housing 90 discussed above and shown in FIGS. 1-20. The outer housing 290, however, also includes covers 384 for coving the top of the spring members 282. The covers 384 may be secured to the coupler ring 284 using fasteners, although any other suitable securing arrangement may be utilized. The covers 384 may include indicia, such as text and/or arrows, to indicate a rotational direction for locking/unlocking the cable connector assembly 222 from the EOC connector assembly 220.

Figure 21:
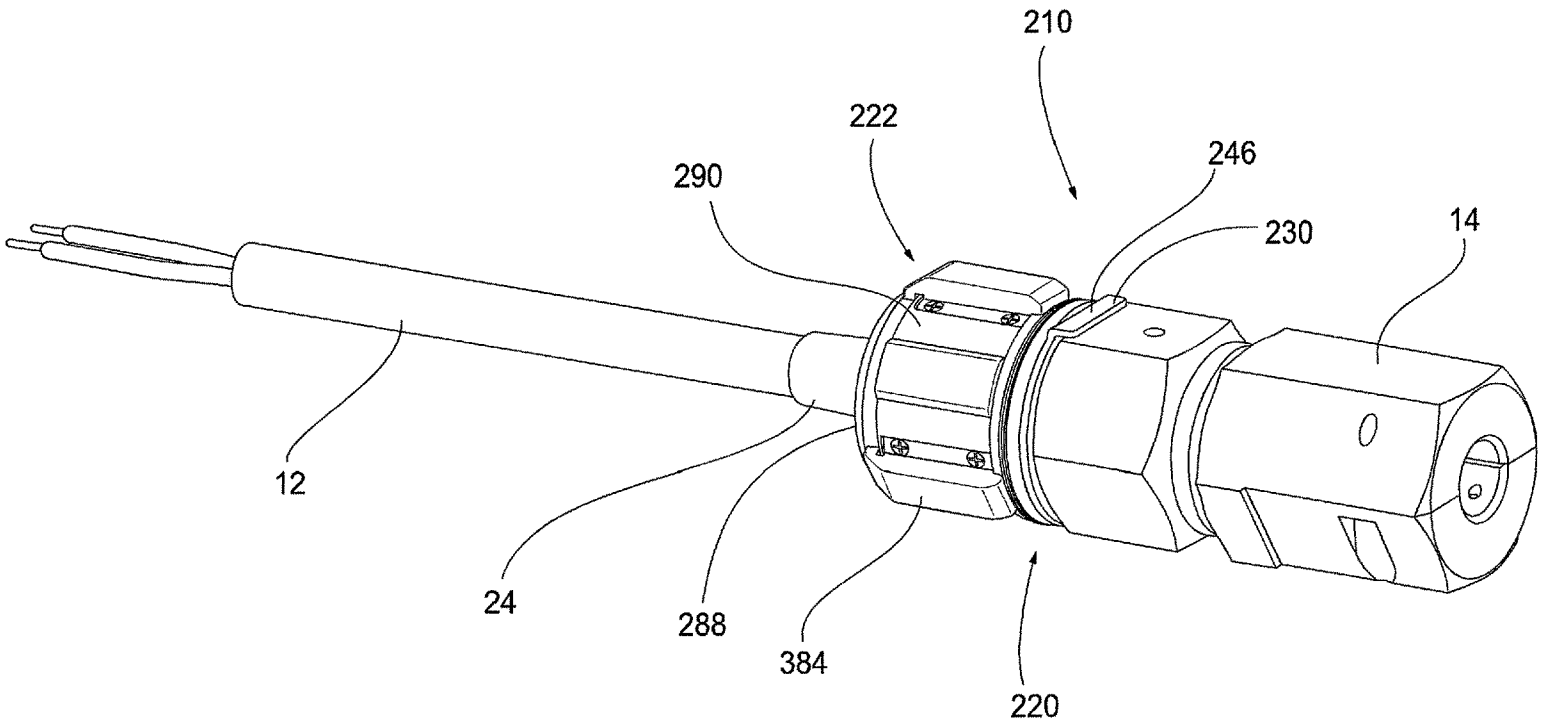
FIG. 21 is a perspective view of a railcar power connector assembly according to one aspect of the present invention.
Figure 22:
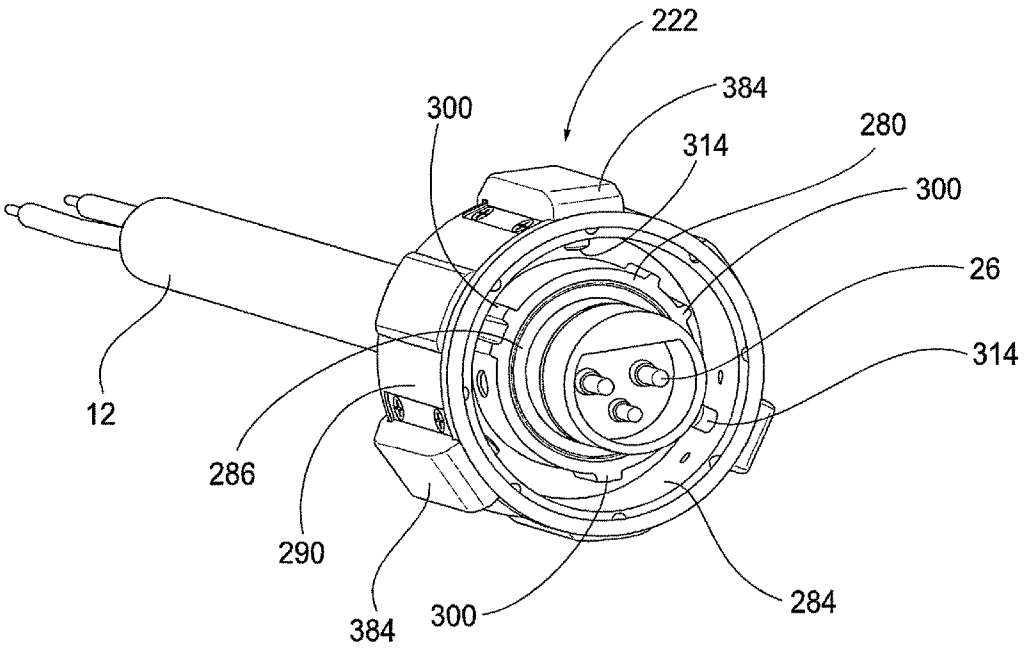
FIG. 22 is a perspective view of a cable connector assembly according to one aspect of the present invention.

Referring to FIGS. 21-23, the cable connector assembly 222 also includes a front seal 386, a face seal 388, a coupler ring washer 390, and a retaining washer 392. The front seal 386 and the face seal 388 are configured to engage and form a seal with the EOC connector body 232 when the EOC connector assembly 220 is connected to the cable connector assembly 222. The coupler ring washer 390 is positioned between portions of the coupler ring 280 and the cable connector body 280. The retaining washer 392 engages a portion of the coupler ring 280 and is configured to retain the outer housing 290 in an axial direction. The front seal 386 may include a metal feature that allows the front seal 386 to be mounted to the outer housing 290 by pressing into the outer housing 290 and spinning the front seal 386. A protruding tab (not shown) may lock the front seal 386 into position by engaging a portion of the covers 384. The retaining washer 392 may be formed integrally with the front seal 386 by molding the seal over the washer 392. In use, the O-ring 253, the rear seal 162, the O-ring 382, the front seal 386, and the face seal 388 form a fully sealed connection between the EOC connector assembly 220 and the cable connector assembly 222.

Referring to FIGS. 22-23, and in one preferred and non-limiting embodiment or aspect, the cable connector assembly 222 is installed onto the cable 12 by sliding the rear cover 288 over the cable 12 and then sliding the rear seal 362 and O-ring 382 over the cable 12. The spring members 282, the coupler ring 284, and the coupler ring washer 390 are then slid over the cable 12. The cable connector body 280 is then slid over the cable 12 and the clamp assembly 286 is installed in the same manner as the clamp assembly 86. The cable connector body 280 is then positioned over the clamp assembly 286 and the coupler ring washer 284 is positioned against the cable connector body 280. The spring members 282 are raised using pins (not shown) or other suitable arrangement and the coupler ring 284 is slid over the cable connector body 280. The covers 384 are then installed over the spring members 282. The O-ring 382 is positioned within the rear cover 288 and the rear seal 362 is positioned within a portion of the cable connector body 280. The rear cover 288 is then installed using the fasteners 380. The cable connector assembly 222 can be readily connected to and disconnected from the EOC connector assembly 220 and also provide a breakaway feature to allow the cable 12 to release from the EOC fitting 14 upon a predetermined axial force applied to the spring members 282 via the cable 12 in the same manner as discussed above in connection with the cable connector assembly 22 and EOC connector assembly 20.

Although the invention has been described in detail for the purpose of illustration based on what is currently considered to be the most practical and preferred aspects, it is to be understood that such detail is solely for that purpose and that the invention is not limited to the disclosed aspects, but, on the contrary, is intended to cover modifications and equivalent arrangements that are within the spirit and scope of the appended claims. For example, it is to be understood that the present invention contemplates that, to the extent possible, one or more features of any aspect described above can be combined with one or more features of any other aspect.

What is claimed is:

1. A railcar power connector assembly comprising:

an end-of-car connector assembly comprising an end-of-car connector body and a threaded member, the threaded member configured to secure the end-of-car connector assembly to an end-of-car fitting positioned on a railcar;

a cable connector assembly comprising a cable connector body and a clamp member, the clamp member configured to be positioned about a cable, the cable connector body defining a central opening and configured to compress the clamp member when the clamp member is received within the cable connector body, wherein the cable connector assembly includes one of a spring member and a securing recess and the end-of-car connector assembly includes the other one of the spring member and the securing recess, the spring member includes a protrusion moveable in a radial direction between a locked position where the protrusion is configured to be received within the securing recess and a released position where the protrusion is configured to be released from the securing recess, the protrusion moveable from the locked position to the released position upon a predetermined axial force applied to the spring member, wherein the cable connector assembly is configured to be secured and removed from the end-of-car connector assembly, the protrusion received within the securing recess when the cable connector assembly is secured to the end-of-car connector assembly, and wherein the end-of-car connector assembly includes an index washer having a projection configured to engage an end-of-car fitting and to align the cable connector assembly relative to the end-of-car connector assembly.

2. The railcar power connector assembly of claim 1, wherein the cable connector assembly includes the spring member and the end-of-car connector body defines the securing recess.

3. The railcar power connector assembly of claim 1, wherein the protrusion comprises a pin, and wherein the securing recess is L-shaped and includes a tapered surface.

4. The railcar power connector assembly of claim 1, wherein the securing recess comprises a locking detent.

5. The railcar power connector assembly of claim 1, wherein the threaded member includes a flange, the flange engaging the end-of-car connector body when the threaded member secures the end-of-car connector body to the end-of-car fitting.

6. The railcar power connector assembly of claim 1, wherein the spring member comprises a body that forms a cantilever spring, and wherein the spring member is rotatable relative to the cable connector body.

7. A railcar power connector assembly comprising:

an end-of-car connector assembly comprising an end-of-car connector body and a threaded member, the threaded member configured to secure the end-of-car connector assembly to an end-of-car fitting positioned on a railcar;

a cable connector assembly comprising a cable connector body and a clamp member, the clamp member configured to be positioned about a cable, the cable connector body defining a central opening and configured to compress the clamp member when the clamp member is received within the cable connector body, wherein the cable connector assembly includes one of a spring member and a securing recess and the end-of-car connector assembly includes the other one of the spring member and the securing recess, the spring member includes a protrusion moveable in a radial direction between a locked position where the protrusion is configured to be received within the securing recess and a released position where the protrusion is configured to be released from the securing recess, the protrusion moveable from the locked position to the released position upon a predetermined axial force applied to the spring member, wherein the cable connector assembly is configured to be secured and removed from the end-of-car connector assembly, the protrusion received within the securing recess when the cable connector assembly is secured to the end-of-car connector assembly, and wherein the cable connector body comprises an outer key extending radially outward from the cable connector body, the outer key of the cable connector body configured to be received by a corresponding key recess of the end-of-car connector body.

8. A railcar power connector assembly comprising:

an end-of-car connector assembly comprising an end-of-car connector body and a threaded member, the threaded member configured to secure the end-of-car connector assembly to an end-of-car fitting positioned on a railcar;

a cable connector assembly comprising a cable connector body and a clamp member, the clamp member configured to be positioned about a cable, the cable connector body defining a central opening and configured to compress the clamp member when the clamp member is received within the cable connector body, wherein the cable connector assembly includes one of a spring member and a securing recess and the end-of-car connector assembly includes the other one of the spring member and the securing recess, the spring member includes a protrusion moveable in a radial direction between a locked position where the protrusion is configured to be received within the securing recess and a released position where the protrusion is configured to be released from the securing recess, the protrusion moveable from the locked position to the released position upon a predetermined axial force applied to the spring member, wherein the cable connector assembly is configured to be secured and removed from the end-of-car connector assembly, the protrusion received within the securing recess when the cable connector assembly is secured to the end-of-car connector assembly, and wherein the cable connector body comprises an inner key extending radially inward from the cable connector body, the inner key of the cable connector body received by a key recess defined by the clamp member.

9. A method of retrofitting a railcar power cable comprising:

positioning a cable connector assembly over an end of a cable, the cable connector assembly comprising a cable connector body, a spring member having a protrusion, and a clamp member, the protrusion moveable relative to the cable connector body between a locked position where the protrusion is configured to be secured to a mating connector and a released position where the protrusion is configured to be released from a corresponding recess of a mating connector, the protrusion moveable from the locked position to the released position upon a predetermined axial force applied to the spring member;

positioning the connector body over the clamp member to secure the cable connector body to the cable;

securing an end-of-car connector body to an end-of-car fitting, the end-of-car connector body defining a securing recess configured to receive the protrusion when the cable connector assembly is secured to the end-of-car connector body.

10. The method of claim 9, wherein the end-of-car connector body is secured to the end-of-car fitting via a threaded member received by a corresponding threaded portion of the end-of-car fitting.

* * * * *